US009348253B2

(12) United States Patent
Kanno et al.

(10) Patent No.: US 9,348,253 B2
(45) Date of Patent: May 24, 2016

(54) IMAGE-FORMING METHOD

(71) Applicant: CANON KABUSHIKI KAISHA, Tokyo (JP)

(72) Inventors: Ichiro Kanno, Abiko (JP); Takeshi Hashimoto, Moriya (JP); Hideki Kaneko, Yokohama (JP); Masayuki Hama, Toride (JP); Nozomu Komatsu, Toride (JP); Takakuni Kobori, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/879,607

(22) Filed: Oct. 9, 2015

(65) Prior Publication Data

US 2016/0103401 A1 Apr. 14, 2016

(30) Foreign Application Priority Data

Oct. 14, 2014 (JP) ..... 2014-209722
Sep. 28, 2015 (JP) ..... 2015-189878

(51) Int. Cl.

| | |
|---|---|
| ***G03G 15/01*** | (2006.01) |
| ***G03G 15/06*** | (2006.01) |
| ***G03G 15/14*** | (2006.01) |
| ***G03G 9/087*** | (2006.01) |

(52) U.S. Cl.
CPC ..... *G03G 15/06* (2013.01); *G03G 9/08797* (2013.01); *G03G 15/14* (2013.01)

(58) Field of Classification Search
CPC ..... G03G 9/08755; G03G 9/0819; G03G 9/08795; G03G 9/08797; G03G 9/0804; G03G 5/0696; G03G 5/047; G03G 5/0607; G03G 5/0611; G03G 5/0612; G03G 5/062
USPC ..... 399/130, 341; 430/56, 58.2
See application file for complete search history.

(56) References Cited

U.S. PATENT DOCUMENTS

| | | | | |
|---|---|---|---|---|
| 5,700,616 | A | 12/1997 | Kasuya et al. | |
| 5,736,288 | A | 4/1998 | Kasuya et al. | |
| 6,020,102 | A | 2/2000 | Fujimoto et al. | |
| 6,180,303 | B1 | 1/2001 | Uematsu et al. | |
| 6,670,087 | B2 | 12/2003 | Fujikawa et al. | |
| 6,751,424 | B2 | 6/2004 | Komatsu et al. | |
| 6,905,808 | B2 | 6/2005 | Itakura et al. | |
| 7,229,727 | B2 | 6/2007 | Itakura et al. | |
| 7,361,441 | B2 | 4/2008 | Itakura et al. | |
| 2007/0003853 | A1* | 1/2007 | Inagaki | G03G 5/142 430/66 |
| 2009/0233212 | A1* | 9/2009 | Fujikawa | G03G 9/0815 430/109.4 |

(Continued)

FOREIGN PATENT DOCUMENTS

| | | | |
|---|---|---|---|
| JP | 2000-66424 | A | 3/2000 |
| JP | 2003-202785 | A | 7/2003 |

(Continued)

*Primary Examiner* — Walter L Lindsay, Jr.
*Assistant Examiner* — Jessica L Eley
(74) *Attorney, Agent, or Firm* — Fitzpatrick, Cella, Harper and Scinto

(57) ABSTRACT

The present invention is an image-forming method in which, when θ(A) is the contact angle relative to water of a surface of a photosensitive member and θ(B) is the contact angle relative to water of a surface of an intermediate transfer member, θ(B) is from 100° to 150°; θ(A) and θ(B) satisfy $-70° \leq \theta(A) - \theta(B) < 0°$; the toner has a toner particle that contains a binder resin; and the contact angle relative to water of a surface of a pellet molding of the toner is from 60° to 80°.

5 Claims, 4 Drawing Sheets

(56) References Cited

U.S. PATENT DOCUMENTS

2013/0316275 A1* 11/2013 Kawasaki ..... G03G 5/144
430/56

FOREIGN PATENT DOCUMENTS

JP 2006-84840 A 3/2006
JP 2009-192901 A 8/2009

* cited by examiner

IMAGE-FORMING METHOD

BACKGROUND OF THE INVENTION

1. Field of the Invention

The present invention relates to an image-forming method used in, for example, electrophotographic apparatuses, electrostatic recording apparatuses, and electrostatic printing apparatuses.

2. Description of the Related Art

Full-color image-forming apparatuses such as full-color printers and full-color copiers have in recent years been required to accommodate a variety of transfer materials, including not only ordinary paper but also recycled paper, which exhibits a large surface unevenness. In order to respond to these demands, transfer methods that use an intermediate transfer member have become the most prominent of the transfer methods used in full-color image-forming apparatuses.

Transfer methods that use an intermediate transfer member require a primary transfer step in which the toner image is transferred from the surface of the photosensitive member (electrophotographic photosensitive member) to the surface of the intermediate transfer member, and a secondary transfer step in which the toner image transferred to the surface of the intermediate transfer member is transferred to the transfer material. Since the number of transfers in transfer methods that use an intermediate transfer member is larger than in transfer methods that do not use an intermediate transfer member, reductions in the dot reproducibility (coarseness) and reductions in the transfer efficiency are a concern with the former.

In addition, many image-forming apparatuses are equipped with a mechanism that uses a cleaning member, e.g., a cleaning blade, to wipe off the toner (untransferred toner) that remains on the surface of the photosensitive member and the surface of the intermediate transfer member. However, residual toner is prone to slip through when high-speed image output is carried out, and over the long-term residual toner can end up accumulating on the surface of the photosensitive member and the surface of the intermediate transfer material. This has resulted in contamination of the photosensitive member and intermediate transfer member by the toner.

One method introduced to improve the primary transferability and improve the anti-contamination behavior of the photosensitive member has been to make the attachment force of the intermediate transfer member surface for the toner smaller than the attachment force of the photosensitive member surface for the toner and thereby facilitate migration of the toner from the photosensitive member to the intermediate transfer member.

An image-forming method is disclosed in Japanese Patent Application Laid-open No. 2003-202785 in which the contact angle relative to water of the surface of the intermediate transfer member is made smaller than the contact angle relative to water of the surface of the photosensitive member.

An image-forming method is disclosed in Japanese Patent Application Laid-open No. 2006-84840 which uses a photosensitive member having a contact angle relative to water at its surface of at least 95° and a ten-point mean roughness Rz for its surface of not more than 2 μm and an intermediate transfer member having a contact angle relative to water at its surface of at least 95° and a ten-point mean roughness Rz for its surface of not more than 2 μm.

An image-forming method is disclosed in Japanese Patent Application Laid-open No. 2009-192901 that uses an intermediate transfer belt equipped with a water-repellent and oil-repellent fluorine-based coating that provides a low attachability to the surface.

However, no disclosure is made in Japanese Patent Application Laid-open No. 2003-202785 with regard to the attachability of the toner itself. The image-forming method disclosed in Japanese Patent Application Laid-open No. 2003-202785 does exhibit an excellent primary transferability in the primary transfer step. However, the secondary transferability in the secondary transfer step has in some cases been unsatisfactory due to the strong attachability of the toner to the intermediate transfer member. In addition, the cleaning performance for the surface of the intermediate transfer member has also been prone to be unsatisfactory.

In the image-forming methods disclosed in Japanese Patent Application Laid-open Nos. 2006-84840 and 2009-192901, the attachability of the intermediate transfer member is not large enough in comparison to the attachability of the photosensitive member and in addition the toner-to-toner attachment force is small. As a consequence, a uniform toner layer cannot be maintained during primary transfer and the problem of "middle dropout"—which is a transfer defect in which only the middle of, for example, a fine line, does not transfer—has readily occurred.

SUMMARY OF THE INVENTION

An object of the present invention is to provide an image-forming method that exhibits an excellent transferability even during high-speed image output using a transfer material that has a large surface unevenness, e.g., recycled paper and so forth, and that even during long-term use can stably output an excellent image.

The present invention is an image-forming method having: a charging step of charging a surface of a photosensitive member; an electrostatic latent image-forming step of forming an electrostatic latent image on the surface of the charged photosensitive member; a developing step of developing the electrostatic latent image with a toner to form a toner image; a primary transfer step of transferring the toner image to a surface of an intermediate transfer member; a cleaning step of removing a residual toner that remains on the surface of the photosensitive member after the primary transfer step; a secondary transfer step of transferring to a transfer material the toner image that has been transferred to the surface of the intermediate transfer member; and a fixing step of fixing to the transfer material the toner image that has been transferred to the transfer material, wherein when θ(A) is a contact angle relative to water of the surface of the photosensitive member and θ(B) is a contact angle relative to water of the surface of the intermediate transfer member, θ(B) is from 100° to 150° and θ(A) and θ(B) satisfy the relationship in the following formula (1);

$$-70° \leq \theta(A) - \theta(B) < 0° \quad (1)$$

the toner has a toner particle that contains a binder resin; and a contact angle relative to water of a surface of a pellet molding of the toner is from 60° to 80°.

The present invention can provide an image-forming method that exhibits an excellent transferability even during high-speed image output using a transfer material that has a large surface unevenness, e.g., recycled paper and so forth, and that even during long-term use can stably output an excellent image.

Further features of the present invention will become apparent from the following description of exemplary embodiments (with reference to the attached drawings).

DESCRIPTION OF THE EMBODIMENTS

Figure 1:
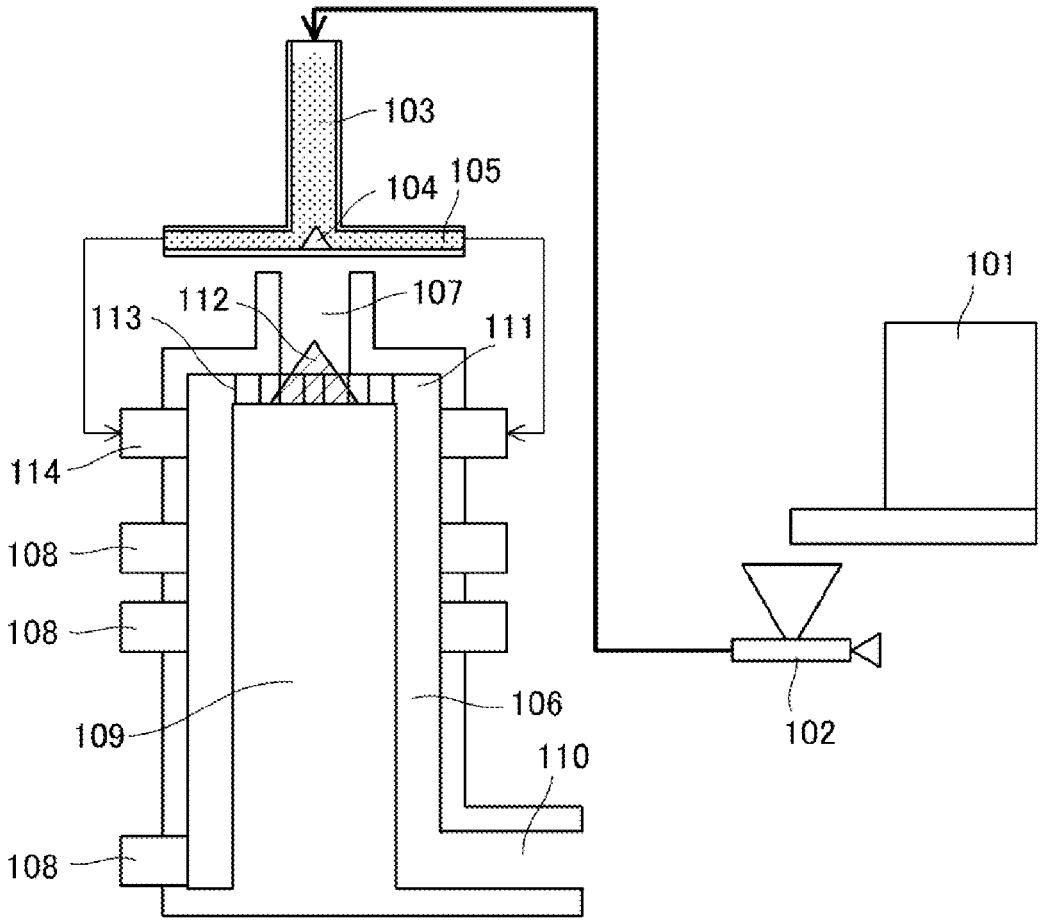
FIG. 1 is a diagram of a heat-sphering treatment apparatus used in the present invention.

The image-forming method of the present invention has a charging step of charging a surface of a photosensitive member; an electrostatic latent image-forming step of forming an electrostatic latent image on the surface of the charged photosensitive member; a developing step of developing the electrostatic latent image with a toner to form a toner image; a primary transfer step of transferring the toner image to a surface of an intermediate transfer member; a cleaning step of removing a residual toner that remains on the surface of the photosensitive member after the primary transfer step; a secondary transfer step of transferring to a transfer material the toner image that has been transferred to the surface of the intermediate transfer member; and a fixing step of fixing to the transfer material the toner image that has been transferred to the transfer material, wherein when θ(A) is the contact angle relative to water of the surface of the photosensitive member and θ(B) is the contact angle relative to water of the surface of the intermediate transfer member, θ(B) is from 100° to 150° and θ(A) and θ(B) satisfy the relationship in the following formula (1);

$$-70° \leq \theta(A)-\theta(B) < 0° \quad (1)$$

the toner has a toner particle that contains a binder resin; and the contact angle relative to water of a surface of a pellet molding of the toner is from 60° to 80°.

The present inventors hold the following views with regard to the operation and effects of the present invention.

In order to obtain the effect of maintaining the primary transferability and the secondary transferability unchanged at excellent levels and to achieve this even when toner image transfer is being carried out repetitively, the present invention focuses on the contact angle relative to water of the surface of the toner and on the relationship between the contact angle relative to water of the surface of the photosensitive member and the contact angle relative to water of the surface of the intermediate transfer member.

Prior image-forming methods have adopted the approach of making the contact angle relative to water of the surface of the photosensitive member larger than the contact angle relative to water of the surface of the intermediate transfer member. In such a case the primary transferability can be maintained at an excellent level. However, toner detachment from the intermediate transfer member during secondary transfer has presented a deteriorating trend during long-term continuous image output to a transfer material having a large surface unevenness, such as recycled paper. In addition, due to a reduction in the attachability of the toner itself, when a toner is used that exhibits a large contact angle relative to water for the toner surface, there have been instances in which a good-quality image has not been obtained due to the ready occurrence of scattering and middle dropout during transfer and the resulting difficulty of forming a uniform toner layer.

Due to this, the contact angle relative to water of the surface of the toner and the relationship between the contact angle relative to water of the surface of the photosensitive member and the contact angle relative to water of the surface of the intermediate transfer member are controlled in the present invention. This has made it possible as a result to maintain an excellent transferability even in the case of long-term continuous image output to a transfer material having a large surface unevenness, such as recycled paper.

One characteristic feature of the present invention is that θ(B) is from 100° to 150° and θ(A) and θ(B) satisfy the relationship in the following formula (1)

$$-70° \leq \theta(A)-\theta(B) < 0° \quad (1)$$

where θ(A) is the contact angle relative to water of the surface of the photosensitive member and θ(B) is the contact angle relative to water of the surface of the intermediate transfer member.

In general, the attachment force of a surface declines as the value of the contact angle θ relative to water of the surface assumes larger values. Even when θ(B) is from 100° to 150°, when this [θ(A)−θ(B)] is less than −70° the attachment force between the toner and the intermediate transfer member is too small in comparison to the attachment force between the toner and the surface of the photosensitive member and as a consequence the formation of a uniform toner layer on the surface of the intermediate transfer member during primary transfer becomes problematic. In addition, even when θ(B) is from 100° to 150°, when this [θ(A)−θ(B)] is 0° or more the content angle relative to water of the surface of the photosensitive member is then too large, and as a consequence the area of contact between the surface of the photosensitive member and the cleaning member during cleaning becomes inadequate and slip-through and faulty cleaning are then prone occur.

The following is a more preferred range for this θ(A)−θ(B).

$$-60° \leq \theta(A)-\theta(B) < -10° \quad (2)'$$

The contact angle θ(A) relative to water of the surface of the photosensitive member can be controlled, for example, by adjusting a roughening treatment administered to the surface of the photosensitive member.

The contact angle θ(B) relative to water of the surface of the intermediate transfer member can be controlled, for example, by adjusting the content of the perfluoropolyether (also referred to as "PFPE" herebelow) in the surface layer of the intermediate transfer member.

The intermediate transfer member used in the image-forming method of the present invention has a θ(B) from 100° to 150° and preferably from 115° to 130°.

When θ(B) is less than 100°, in the case of the present invention the attachment force between the toner and the surface of the intermediate transfer member is then large and a good secondary transferability to transfer materials having a large surface unevenness is not obtained during secondary transfer. When θ(B) exceeds 150°, the attachment force between the toner and the surface of the intermediate transfer member is too small and it is difficult to form a uniform toner layer on the intermediate transfer member during primary transfer.

The intermediate transfer member used in the film-forming method of the present invention preferably has a substrate layer and a surface layer. This surface layer preferably has, in the cross section in its thickness direction, a matrix-domain structure having a matrix and domains. The matrix in the matrix-domain structure preferably contains a binder resin.

The domains in the matrix-domain structure preferably contain PFPE. PFPE is a material that can lower the attachability of the toner.

By incorporating PFPE in the domains of the matrix-domain structure, PFPE is then continuously present at the surface of the intermediate transfer member even when image output is carried out repetitively and the surface layer of the intermediate transfer member is subject to various types of chemical and physical deterioration. An excellent transferability can be maintained as a result. The present inventors confirmed that when the surface of the intermediate transfer member was measured by X-ray photoelectron spectroscopy (ESCA) after a large number of images had been output using an intermediate transfer member according to the present invention, the peaks originating with the PFPE were detected at about the same values as at the start of image output.

In addition, an effect at the level when PFPE is used is not obtained when polytetrafluoroethylene (PTFE), which is a fluorine compound like PFPE, is dispersed in the surface layer of the intermediate transfer member.

Different materials other than PFPE may also be incorporated in the domains. For example, additives compatible with PFPE may be incorporated in the domains with the goal of adjusting other properties. Moreover, the domains need not be entirely occupied by PFPE and voids may be present. The PFPE content in the domains is preferably from 10 mass % to 50 mass % and is more preferably from 20 mass % to 50 mass %.

The PFPE-containing domains are phase-separated from the binder resin-containing matrix.

However, even when this phase separation occurs, there is no limitation to a strict separation of the component compositions of the matrix and domain. Even with a matrix-domain structure having a clear interface between the matrix and the domain, both phases (matrix and domain) may contain very small amounts of components of the other phase. In addition, it is reported in the academic literature that an intermediate composition is also present over a very narrow width of around 10 nm at the interface between the matrix and domain.

The presence/absence of the matrix-domain structure in the surface layer of the intermediate transfer member can be determined by sectioning the intermediate transfer member and observation using a scanning electron microscope (also referred to herebelow as "SEM") of the cross section in the thickness direction of the surface layer of the intermediate transfer member.

The average long diameter of the domains as measured by SEM is preferably from 30 nm to 3,000 nm and is more preferably from 100 nm to 1,000 nm. The attachability of the intermediate transfer member for the toner can be further reduced by having the average long diameter of the domains be from 30 nm to 3,000 nm, i.e., by the domains having a certain size. The average long diameter of the domains can be controlled by adjusting the amount of dispersing agent used during formation of the surface layer.

The proportion of the domain area in a unit area (15 $\mu m^2$) of the cross section in the thickness direction of the surface layer of the intermediate transfer member is, with reference to the area of the matrix, preferably from 1 area % to 50 area % and more preferably from 3 area % to 30 area %. The attachability of the intermediate transfer member for the toner can be further reduced by having the proportion of the domain area be from 1 area % to 50 area % with reference to the area of the matrix, i.e., by the domains having a certain proportion.

The presence of PFPE in the domains can be identified by detection using an elemental analysis method such as energy-dispersive X-ray analysis (EDX), TOF-SIMS, or Auger spectroscopy. For example, the fluorine atom can be detected, and thus the domains can be identified as domains that contain PFPE, by elemental analysis of the domains in the intermediate transfer member of the present invention by EDX. In addition, the PFPE-derived fragments of the fluorocarbon ether structure from a domain can also be measured using TOF-SIMS.

An intermediate transfer member having the shape of a belt, drum, or roller or having some other shape can be used as the intermediate transfer member according to the present invention.

[The Electrophotographic Apparatus]

Figure 2:
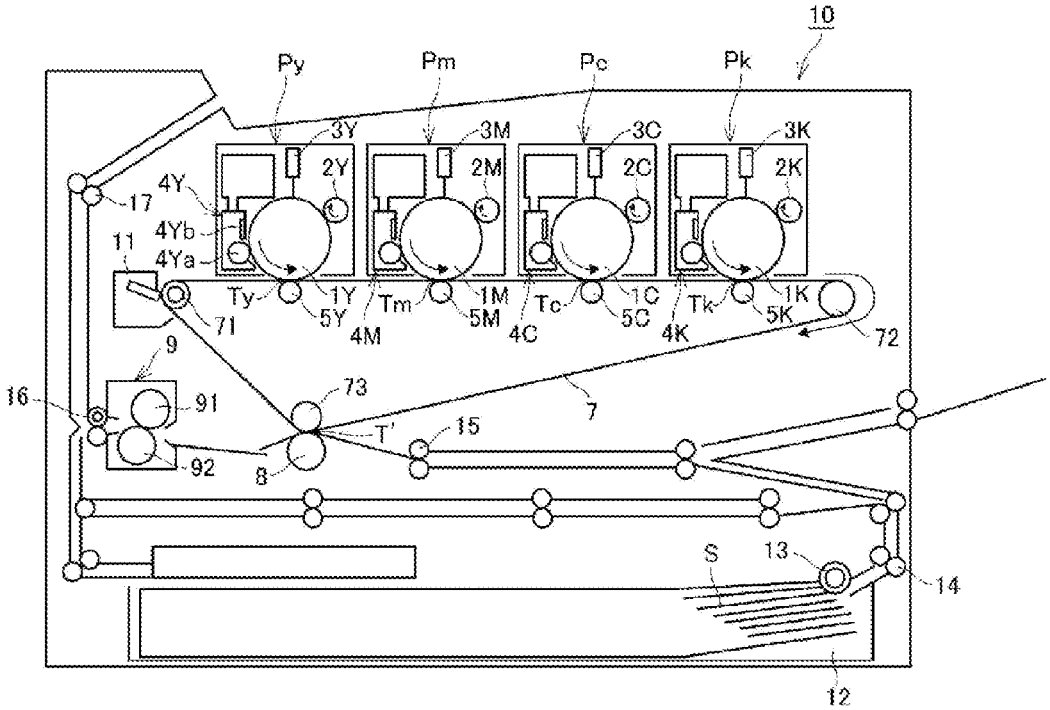
FIG. 2 is a schematic diagram that shows an example of an electrophotographic apparatus of the present invention.

The image-forming apparatus 10 shown in FIG. 2 is a full-color image-forming apparatus based on an electrophotographic system (full-color laser printer).

The image-forming apparatus 10 shown in FIG. 2 is provided with an intermediate transfer belt 7, which is a belt-shaped intermediate transfer member. The following are successively disposed along the flat run of the intermediate transfer belt 7 considered in the direction of its movement: image-forming units Py, Pm, Pc, and Pk, which are image-forming sections for the individual color components yellow (Y), magenta (M), cyan (C), and black (K). Because the individual image-forming units have the same basic structure, the details of the image-forming units will be described with reference to only the yellow image-forming unit Py.

This yellow image-forming unit Py has a photosensitive drum 1Y, which is a drum-shaped electrophotographic photosensitive member (electrostatic latent image-bearing member). The photosensitive drum 1Y is formed by successively stacking a charge generation layer, a charge transport layer, and a surface protection layer on an aluminum cylinder functioning as a substrate.

The yellow image-forming unit Py is also provided with a charging roller 2Y as charging means. The surface (circumference) of the photosensitive drum 1Y is uniformly charged by the application of a charging bias to the charging roller 2Y.

A laser exposure apparatus 3Y is disposed as imagewise exposure means above the photosensitive drum 1Y. The laser exposure apparatus 3Y carries out scanning exposure, in correspondence to the image information, on the surface of the uniformly charged photosensitive drum 1Y, to thereby form an electrostatic latent image for the yellow color component on the surface of the photosensitive drum 1Y.

The electrostatic latent image formed on the photosensitive drum 1Y is developed with toner, i.e., the developer, by a developing device 4Y functioning as developing means. The developing device 4Y is provided with a developing roller 4Ya functioning as a developer-bearing member and with a regulating blade 4Yb functioning as a member that regulates the amount of the developer. A yellow toner is provided as the developer. The developing roller 4Ya, which supplies the yellow toner, resides in light-pressure contact with the photosensitive drum 1Y in the developing zone and rotates while presenting a velocity difference in the forward direction with the photosensitive drum 1Y. The yellow toner transported to the developing zone by the developing roller 4Ya attaches, under the application of a developing bias to the developing roller 4Ya, to the electrostatic latent image formed on the photosensitive drum 1Y. A toner image (yellow toner image) is formed on the photosensitive drum 1Y as a result.

The intermediate transfer belt 7 runs in a tensioned condition over a driver roller 71, a tension roller 72, and a driven roller 73 and moves (driven in a circuit) in the direction of the arrow in FIG. 2 while in contact with the photosensitive drum 1Y. The yellow toner image that has reached the primary transfer zone Ty is transferred onto the intermediate transfer belt 7 by a primary transfer roller 5Y functioning as a primary transfer member, which is in a pressing contact across the intermediate transfer belt 7 against the photosensitive drum 1Y.

Toner images in the four colors of yellow, magenta, cyan, and black are stacked on the intermediate transfer belt 7 by similarly carrying out the imaging process described above accompanying the movement of the intermediate transfer belt 7 using the individual units Pm, Pc, and Pk for magenta (M), cyan (C), and black (K). The four-color toner image is transported accompanying the movement of the intermediate transfer belt 7 and in a secondary transfer zone T' is transferred in its totality, by a secondary transfer roller 8 functioning as secondary transfer means, onto a transfer material S, which has been transported at a specified timing. A transfer voltage of several kV is often applied in secondary transfer in order to ensure a satisfactory transfer ratio, but this can also produce a discharge in the vicinity of the nip in the secondary transfer zone. This discharge is one cause of chemical deterioration of the transfer members, e.g., the intermediate transfer member.

The transfer material S is stored in a cassette 12, which is a transfer material storage member; is picked up by a pick-up roller 13; and is transported by the transport roller pair 14 and the resist roller pair 15 to the secondary transfer zone T' in synchronization with the four-color toner image that has been transferred to the surface of the intermediate transfer belt 7.

The toner image that has been transferred to the transfer material S is fixed by a fixing unit 9 functioning as fixing means to provide a full-color image. The fixing unit 9 has a fixing roller 91 equipped with heating means and has a pressure-application roller 92 and fixes the unfixed toner image on the transfer material S to the transfer material S by the application of heat and pressure.

The transfer material S is subsequently discharged from the image-forming apparatus by a transport roller pair 16 and a discharge roller pair 17.

A cleaning blade 11 functioning as cleaning means for the intermediate transfer belt 7 is disposed downstream from the secondary transfer zone T' considered in the direction in which the intermediate transfer belt 7 moves in a circuit, and removes the toner (untransferred toner) that was not transferred in the secondary transfer zone T' to the transfer material S and thus remains on the surface of the intermediate transfer belt 7.

As described above, this process of transferring a toner image from the photosensitive member to the intermediate transfer belt and from the intermediate transfer belt to the transfer material is carried out repeatedly. The transfer process may also be carried out repetitively by repetitive recording to a large number of the transfer material.

According to investigations by the present inventors, the intermediate transfer member disclosed in Japanese Patent Application Laid-open No. 2009-192901 provided an excellent image quality during initial image output.

However, when image output was carried out continuously, the transferability of the intermediate transfer member gradually declined and the image quality declined to the same level as when an intermediate transfer member not coated with a fluorine compound was used.

This phenomenon is thought to be produced because the water-repellent and oil-repellent fluorine compound coated on the surface of the intermediate transfer member undergoes deterioration by the repetition of the transfer process.

This deterioration is thought to be caused by the following (i) and (ii).

(i) Chemical deterioration of the surface of the intermediate transfer member by the discharge produced by the application of high voltage during transfer.

(ii) Physical deterioration of the surface of the intermediate transfer member by, for example, scratching of the surface layer by, for example, cleaning.

This analysis is based on the following experimental facts.

First, a decline in the transferability of an intermediate transfer member used on a long-term basis was a phenomenon frequently seen when a pulverized toner was used from among the types of toner. Due to this, it was thought that the properties of the surface of the intermediate transfer member were altered due to the attachment to the intermediate transfer member of the wax exposed at the surface of the toner particle.

However, the decline in image quality was not recovered even when, after repetitive image output, the wax on the surface of the intermediate transfer member was carefully wiped off with a solvent.

Second, when the surface of the intermediate transfer member was measured by X-ray photoelectron spectroscopy (XPS), the fluorine atom was present at 10 atom % to 30 atom % at the surface of the intermediate transfer member immediately after the surface of the intermediate transfer member had been coated with a fluorine compound.

However, the fluorine atom was present at the surface of the intermediate transfer member at only a few percent or less after the image output of 1,000 prints or more.

Third, when the contact angle relative to hexadecane was measured on the surface of the intermediate transfer member, it was at least 40° immediately after the fluorine compound had been coated on the surface of the intermediate transfer member.

However, it was not more than 20° after the repetitive image output of several thousand prints or more.

Figure 3:
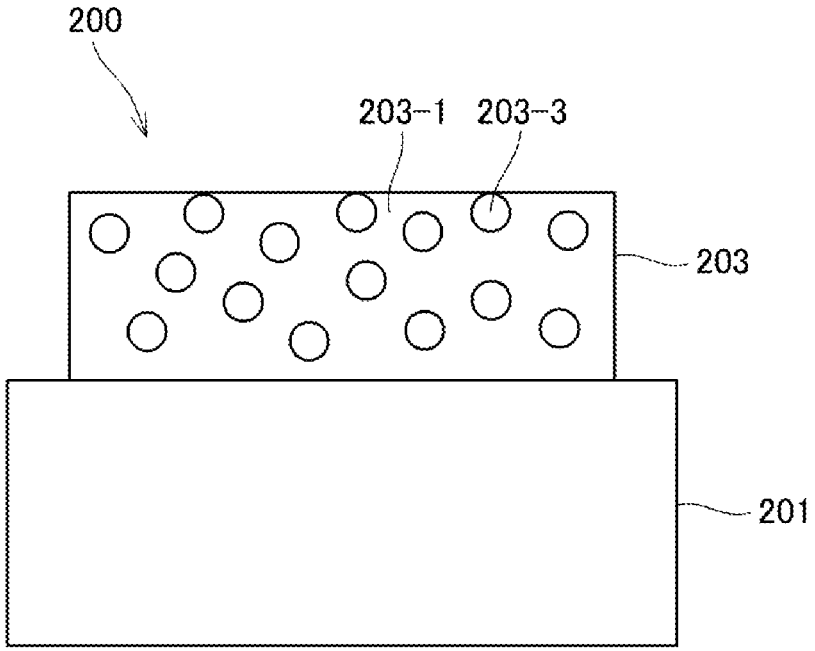
FIG. 3 is a schematic cross-sectional diagram in the thickness direction of the intermediate transfer member according to the present invention.

FIG. 3 is a diagram that shows a preferred embodiment of an intermediate transfer member 200 according to the present invention and is a cross-sectional diagram in the thickness direction.

The intermediate transfer member 200 has a substrate layer 201 and a surface layer 203. Considered in its thickness direction, the surface layer 203 has a matrix-domain structure that has a matrix 203-1 and a domain 203-3 present in the matrix 203-1. Here, the matrix 203-1 contains a binder resin and the domain 203-3 contains PFPE.

The surface of the intermediate transfer member 200, that is, the surface of the surface layer 203 that carries the toner image, preferably has a microhardness as measured with an ultramicrohardness tester of at least 50 MPa.

An intermediate transfer member having such a structure can maintain an excellent transferability even during repetitive image formation and can stably output a high-quality image on a long-term basis.

The present inventors believe that these effects are due to (1) the microhardness of the surface of the intermediate transfer member and (2) the surface layer that has a matrix-domain structure in the thickness direction.

[The Microhardness]

The surface of the intermediate transfer member according to the present invention preferably has a microhardness as measured with an ultramicrohardness tester of at least 50 MPa.

The transferability of the intermediate transfer member is influenced by the attachment force of the toner for the surface thereof. A larger contact area between the toner and the surface of the intermediate transfer member results in a larger attachment force of the toner to the surface of the intermediate transfer member.

The contact area between the toner and the surface of the intermediate transfer member can be lowered by having the microhardness of the surface of the intermediate transfer member as measured with an ultramicrohardness tester be at least 50 MPa. As a result, the attachment force of the toner to the surface of the intermediate transfer member can be restrained and an excellent secondary transferability is then brought about. The microhardness of the surface of the intermediate transfer member is preferably at least 80 MPa and is more preferably at least 100 MPa.

The microhardness of the surface of the intermediate transfer member as measured with an ultramicrohardness tester is, on the other hand, preferably not more than 400 MPa and more preferably not more than 380 MPa.

When the intermediate transfer member has a substrate layer and a surface layer, the microhardness of the surface of the intermediate transfer member can be controlled through the components used for formation of the surface layer. When the surface layer has a matrix-domain structure, control can be exercised through the type and amount of use of the binder resin present in the matrix, the material (for example, PFPE) present in the domain, the solvent, the dispersing agent, and so forth, and through their combination.

[The Matrix-Domain Structure]

PFPE has an unusually low surface free energy. Due to this, it is a material that through its incorporation in the surface layer of the intermediate transfer member can reduce the attachability of the toner to the surface of the surface layer.

Due to its property of having an unusually low surface free energy, PFPE readily migrates to the interface with the air, i.e., to the surface side of the surface layer. That is, PFPE readily skews to the surface side of the surface layer.

The present inventors discovered that when PFPE, having such a property, is used in the surface layer of the intermediate transfer member, the PFPE is preferably caused to be distributed in the thickness direction of the surface layer by incorporating the PFPE as domains in a matrix that constitutes the surface layer.

This matrix-domain structure exhibits a configuration in which the PFPE is present not only on the surface side of the surface layer of the intermediate transfer member, but is also present over the surface layer as a whole, and also exhibits a configuration in which the PFPE is present in large amounts in the surface layer. As a consequence, even when image output is carried out repetitively and the surface layer of the intermediate transfer member undergoes chemical and/or physical deterioration and the PFPE at the surface is lost, the continuous presence of PFPE at the surface of the surface layer can still be brought about due to the exposure at the surface of the surface layer of the domains of PFPE that are present in the interior of the surface layer. This then makes it possible to maintain an excellent transferability for the intermediate transfer member.

This can also be corroborated by the following result: when an intermediate transfer member having this matrix-domain structure is subjected to surface analysis by X-ray photoelectron spectroscopy (XPS) after its participation in the image output of a large number of prints, the PFPE-based peaks are detected at values approximately equal to those for the starting condition.

In addition, because, as noted above, the surface layer of an intermediate transfer member that is a preferred embodiment of the present invention has a matrix-domain structure in the thickness direction, the PFPE-containing domains are distributed across the thickness direction of the surface layer, i.e., are distributed running from the substrate layer side of the surface layer to its surface layer side.

With a surface layer having such a structure, a portion of the domains located at the surface side of the surface layer are either in an exposed state at the surface or are exposed in the initial stage of image formation. As a result, a state is also formed at the surface of the surface layer in which the PFPE-containing domains are scattered as dots in the matrix. This is a preferred configuration because it is difficult for toner to stick to a surface that has regions of different attachability for toner and an excellent transferability can thus be maintained.

Moreover, through the type and combination of the components used to form the surface layer of the intermediate transfer member, for example, the binder resin in the matrix, the PFPE, the solvent, and the dispersing agent, a structure can be made in which voids are present in a portion of the PFPE domains exposed at the surface of the surface layer. The surface is readily shaved or planed by physical action due to rubbing by, for example, the cleaning blade or paper, in the case of a configuration in which depressed portions are scattered like islands over the surface due to the presence of these voids. As a result, the emergence onto the surface of PFPE domains present in the thickness direction is facilitated due to a promotion of the supply of PFPE from the PFPE domain at the depressed portion and because an easy-to-plane surface has been established. The function of the PFPE is effectively expressed as a result. In addition, the attachment force of the toner to the surface of the intermediate transfer member is reduced because the area of contact between the surface and the toner is reduced due to the depressed portions. In view of these functionalities, a structure in which voids are present in a portion of the PFPE domains exposed at the surface of the intermediate transfer member can be regarded as a preferred embodiment for a structure that maintains an excellent transferability. The effects due to the depressed portions may also be realized by controlling the surface morphology using physical surface processing such as nanoimprinting, a lapping treatment, and so forth.

With regard to the surface layer of the intermediate transfer member for which the matrix-domain structure is observed in the cross section in the thickness direction, a configuration in which PFPE-containing regions are scattered like islands is readily formed at the surface. Due to this, a configuration in which PFPE-containing regions are scattered like islands is frequently seen when the surface of the intermediate transfer member is observed by SEM. In such cases, the size of the scattered domains observed at the surface and the proportion of the surface taken up by the domains are preferably the same as the numerical value ranges measured for each in SEM observation of the cross section. In specific terms, the average long diameter of the domains is preferably from 30 nm to 3,000 nm and is more preferably from 100 nm to 1,000 nm. The area proportion for the domains is preferably from 1 area % to 50 area % with reference to the area of the matrix.

The structure of the intermediate transfer member will be described using as an example a belt-shaped intermediate transfer member (intermediate transfer belt) having a substrate layer and a surface layer wherein the surface layer has a matrix-domain structure.

[The Substrate Layer]

The substrate layer of the intermediate transfer member preferably contains a resin and an electroconductive agent and is preferably a semiconducting layer (film).

The resin used for the substrate layer can be exemplified by polyimide, polyamideimide, polyetheretherketone, polyphenylene sulfide, and polyester. Polyimide, polyamideimide, and polyetheretherketone are preferred among the preceding from a strength standpoint. Only a single resin may be used or two or more may be used.

The electroconductive agent for the substrate layer can be exemplified by electronic conductive materials such as carbon black, antimony-doped tin oxide, titanium oxide, and electroconductive polymers, and by ionic conductive materials such as sodium perchlorate, lithium, cationic ionic surfactants and anionic ionic surfactants, nonionic surfactants, and oligomers and polymers that have an oxyalkylene repeat unit.

The volume resistivity of the substrate layer is preferably from $1.0\times10^{7}$ Ω·cm to $1.0\times10^{12}$ Ω·cm. The surface resistivity of the substrate layer is preferably from $1.0\times10^{8}$Ω/□ to $1.0\times10^{14}$Ω/□. Image defects caused by charge-up during continuous driving and a deficient transfer bias can be suppressed by having the volume resistivity of the substrate layer be from $1.0\times10^{7}$ Ω·cm to $1.0\times10^{12}$ Ω·cm. Image defects caused by toner scattering and separation discharge when the transfer material separates from the intermediate transfer belt can be suppressed by having the surface resistivity be from $1.0\times10^{8}$Ω/□ to $1.0\times10^{14}$Ω/□.

The volume resistivity and surface resistivity of the intermediate transfer member provided by forming a surface layer on a substrate layer are also preferably approximately the same values as for the substrate layer. Due to this, the surface layer of the intermediate transfer member is also preferably a semiconducting layer.

That is, the volume resistivity of the intermediate transfer member is preferably from $1.0\times10^{7}$ Ω·cm to $1.0\times10^{12}$ Ω·cm. The surface resistivity of the intermediate transfer member is preferably from $1.0\times10^{8}$Ω/□ to $1.0\times10^{14}$Ω/□.

The surface layer preferably contains an electroconductive agent in order to adjust the volume resistivity and surface resistivity of the intermediate transfer member.

The electroconductive agent contained in the surface layer can be exemplified by electronic conductive materials such as carbon black, antimony-doped tin oxide, titanium oxide, and electroconductive polymers, and by ionic conductive materials such as sodium perchlorate, lithium, cationic ionic surfactants and anionic ionic surfactants, nonionic surfactants, and oligomers and polymers that have an oxyalkylene repeat unit.

[The Matrix]

The binder resin present in the matrix of the surface layer can be exemplified by styrene resins, acrylic resins, methacrylic resins, epoxy resins, polyester resins, polyether resins, silicone resins, and polyvinyl butyral resins. A single binder resin may be used by itself or two or more may be used.

The binder resin is used in order to disperse the domains of, e.g., PFPE, ensure adhesiveness with the substrate layer, and ensure the mechanical strength properties.

Among the binder resins cited above, the methacrylic resins and acrylic resins (referred to below as "(meth)acrylic resins" as a collective term for methacrylic resins and acrylic resins) are preferred because they make it possible to bring about an excellent dispersion of the domains (particularly PFPE domains).

A surface layer in which the matrix contains a (meth) acrylic resin as the binder resin and the domains contain PFPE can be formed, for example, by the following method. First, the polymerizable monomer for forming the (meth)acrylic resin, a solvent, PFPE, and a dispersing agent are subjected to a dispersing treatment in a wet disperser and the resulting dispersion is coated on the substrate layer by a coating method such as bar coating or spray coating to form a coating film. The obtained coating film is dried to remove the solvent and the surface layer is then formed by polymerization by a curing method (curing polymerization method) such as thermal curing, electron beam curing, UV curing, and so forth.

A polymerization initiator, e.g., Irgacure (product name) from Ciba-Geigy, may be used to bring about polymerization. Other additives may also be used, e.g., the aforementioned electroconductive agent, an oxidation inhibitor, a leveling agent, a crosslinking agent, a flame retardant, and so forth. A solid filler may be used for reinforcement.

The content of the binder resin in the surface layer, expressed with reference to the total mass of the surface layer, is preferably from 20.0 mass % to 95.0 mass % and more preferably from 30.0 mass % to 90.0 mass %.

Viewed from the perspective of the durability, the film thickness of the surface layer is preferably at least 1 μm, and, viewed from the perspective of the flexural resistance when the belt is tensioned, is preferably not more than 20 μm and is more preferably not more than 10 μm.

The polymerizable monomer for forming the (meth)acrylic resin can be exemplified by the following.

(i) pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, and bisphenol A diacrylate (ii) pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate, and bisphenol A dimethacrylate A polymer having a unit obtained by the polymerization of the aforementioned (meth)acrylate is preferred for the (meth) acrylic resin.

A hard binder resin is preferred from the standpoint of reducing the attachment force. Due to this, in the case of use of a (meth)acrylic resin, a high hardness is preferably achieved using difunctional or higher functional crosslinkable monomer (difunctional or higher functional (meth)acrylates). In specific terms, the average of the number of (meth) acrylic functional groups in the polymerizable monomer is preferably at least 2, more preferably at least 3, and even more preferably at least 4. A high-hardness resin with such a high crosslinkability has a strong tendency to be thermosettable, and viewed from this standpoint the use is preferred in the surface layer of the intermediate transfer member of a thermosetting resin, encompassing (meth)acrylic resins and others.

[Properties of the Binder Resin in the Matrix]

The binder resin contained in the matrix is preferably a solid. Specifically, the glass transition temperature of the binder resin is preferably at least as high as the use temperature region. More specifically, the glass transition temperature of the binder resin is preferably at least 40° C. and is more preferably at least 50° C.

The microhardness of the binder resin is preferably at least 250 MPa. The plastic deformation hardness of the binder resin is preferably at least 40 kg/mm$^2$. The maximum amount of indentation deformation for the binder resin is preferably not more than 0.3 μm. The Young's modulus of the binder resin is preferably at least 5.0 GPa. The conditions for measuring the properties values using an ultramicrohardness tester are described below.

The surface layer of the intermediate transfer member preferably has a mass loss in the Taber abrasion test (JIS K-7204, load: 4.9 N, rotation rate: 100 rpm) of not more than 4.0 mg. The mass loss for the binder resin in the matrix, measured by the same procedure, is preferably not more than 4.5 mg.

[The Domains]

The PFPE constituting the domains in the present invention is an oligomer or polymer that has a perfluoroalkylene ether as a unit.

The perfluoroalkylene ether unit can be exemplified by the perfluoromethylene ether unit, perfluoroethylene ether unit, and perfluoropropylene ether unit. Commercially available perfluoroalkylene ethers can be exemplified by Demnum (product name) from Daikin Industries, Ltd., Krytox (product name) from DuPont, and Fomblin (product name) from Solvay Solexis, Inc.

Among the PFPEs, a PFPE having a unit 1 given by formula (a) below and/or a unit 2 given by formula (b) below is preferred.

(a)

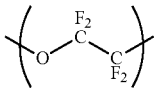

(b)

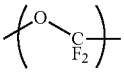

Among the PFPEs, a PFPE is also preferred that has a reactive functional group capable of forming a bonded state or a near-bonded state with the binder resin in the surface layer of the intermediate transfer member. The basis for this is as follows: due to its interaction with the binder resin, the migration of PFPE contained in the surface layer to the surface is suppressed, and as a result PFPE-containing domains are then more easily formed in the surface layer of the intermediate transfer member.

This reactive functional group can be exemplified by the acrylic group, methacrylic group, and oxysilanyl group.

PFPE having such a reactive functional group can be exemplified by Fluorolink MD500, MD700, 5101X, 5113X, and AD1700 (the preceding are product names), which contain the acrylic group or methacrylic group and are from Solvay Solexis, Inc., Optool DAC from Daikin Industries, Ltd., and Fluorolink S10 (the preceding are product names), which is a silane coupling agent. Preferred thereamong is PFPE having the structure given by the following formula (1) or PFPE having the structure given by the following formula (2).

(1)

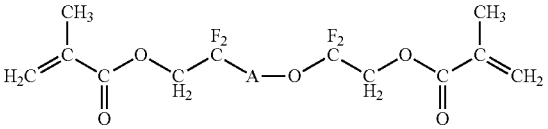

(In formula (1), A is a moiety formed from a unit 1 and/or a unit 2; the repeat number p for unit 1 and the repeat number q for unit 2 are each independently $0 \le p \le 50$ and $0 \le q \le 50$; $p+q \ge 1$; and when A has both a unit 1 and a unit 2, unit 1 and unit 2 may form a block copolymer structure or may form a random copolymer structure.)

(2)

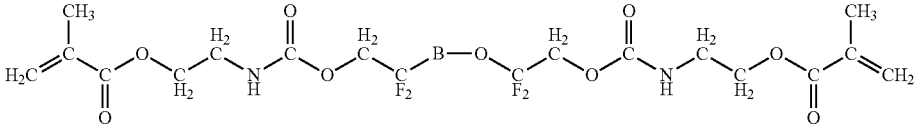

(In formula (2), B is a moiety formed from a unit 1 and/or a unit 2; the repeat number r for unit 1 and the repeat number s for unit 2 are each independently $0 \le r \le 50$ and $0 \le s \le 50$; $r+s \ge 1$; and when B has both a unit 1 and a unit 2, unit 1 and unit 2 may form a block copolymer structure or may form a random copolymer structure.)

The number-average molecular weight of the PFPE is preferably from 100 to 20,000 and is more preferably from 380 to 20,000.

The PFPE in the surface layer of the intermediate transfer member may be immobilized or may not be immobilized, and immobilized PFPE and non-immobilized PFPE may be present in combination. The preferred PFPE content in a combined system is considered to be a content that combines an amount of PFPE sufficient to lower the surface free energy of the surface of the intermediate transfer member with an amount of PFPE sufficient to maintain PFPE domains in the interior of the surface layer of the intermediate transfer member. In addition, with regard to the PFPE domains under these circumstances, even when the surface layer has undergone chemical and/or physical deterioration due to repetitive image output, preferably PFPE continues to be present in the surface layer and PFPE is contained in the surface layer in an amount sufficient for an excellent transferability to continue to occur. According to the results of investigations by the present inventors, the PFPE content in the surface layer, considered in terms of bringing about a long-term occurrence of the inhibitory effect on the attachment of toner to the surface of the intermediate transfer member, is preferably from 5.0 mass % to 70.0 mass %, more preferably from 10.0 mass % to 60.0 mass %, and even more preferably from 20.0 mass % to 50.0 massa, in each case with reference to the total mass of the surface layer.

A dispersing agent may be incorporated in the surface layer in order to cause the PFPE in the surface layer of the intermediate transfer member to be stably present in domain form. This dispersing agent can be exemplified by surfactants, amphiphilic block copolymers, and amphiphilic graft copolymers that in each case are compounds that have a perfluoroalkyl chain and a segment that exhibits affinity with hydrocarbon and are thus compounds that have a fluorophilic+fluorophobic amphiphilicity. The following are preferred among the preceding:

(i) block copolymers obtained by the copolymerization of a fluoroalkyl group-bearing vinyl monomer and an acrylate or methacrylate, and (ii) comb graft copolymers obtained by the copolymerization of a fluoroalkyl group-bearing acrylate or methacrylate with a methacrylate macromonomer having a polymethyl methacrylate in side chain position.

The block copolymer (i) can be exemplified by "Modiper F200", "Modiper F210", "Modiper F2020", "Modiper F600", and "Modiper FT-600" (all product names) from the NOF Corporation. The comb graft copolymer (ii) can be exemplified by "Aron GF-150", "Aron GF-300", and "Aron GF-400" (all product names) from Toagosei Co., Ltd.

The content of the dispersing agent, expressed with reference to the total mass of the surface layer, is preferably from 1.0 mass % to 70.0 mass % and more preferably from 5.0 mass % to 60.0 mass %.

In the Production Examples provided below, the domains are formed in a precursor state when the polymerizable monomer for forming the binder resin, e.g., a (meth)acrylic resin, solvent, PFPE, and optionally a dispersing agent are dispersed in a wet disperser. The resulting dispersion is applied onto the substrate layer, by a coating method such as bar coating, spray coating, ring coating, and so forth, and the resulting coating film is dried to remove the solvent. After this, a surface layer having the matrix-domain structure can be formed on the substrate layer by carrying out polymerization by a curing method (curing polymerization method) such as, e.g., thermal curing, electron beam curing, UV curing, and so forth.

The ultramicrohardness tester used to measure the microhardness of the surface of the intermediate transfer member can also be used to measure the plastic deformation hardness, the maximum amount of indentation, and the Young's modulus. The plastic deformation hardness of the intermediate transfer member is preferably at least 15 kg/mm$^2$. The maximum amount of indentation deformation of the intermediate transfer member is preferably not more than 0.4 The Young's modulus of the intermediate transfer member is preferably at least 2.0 GPa. These measurements are preferably carried out at a deformation of from several % to 20% of the film thickness of the layer.

[The Intermediate Transfer Member Production Method]

[The Substrate Layer Production Method]

The substrate layer of the intermediate transfer member can be produced, for example, by the following method.

In the case of use of a thermosetting resin, e.g., a polyimide, for the substrate layer, a semiconducting film can be molded by dispersing the electroconductive agent (for example, carbon black) to make a varnish along with a solvent and a precursor for the thermosetting resin or the soluble thermosetting resin; coating this varnish in the mold of a centrifugal molder; and carrying out a baking step in which the coated article is baked. The film thickness of the semiconducting film that will form the substrate layer is preferably from 30 μm to 150 μm.

In the case of use of a thermoplastic resin for the substrate layer, a semiconducting resin composition is prepared by mixing the electroconductive agent (for example, carbon black) and the thermoplastic resin and any optional additives and melt-kneading with, for example, a twin-screw kneading device. A semiconducting film can then be obtained by a method in which the resin composition is melted and extruded into a sheet, film, or seamless belt shape. The method for producing a seamless belt may be a method in which the seamless belt is made by extrusion from a cylindrical die and a method in which sheets formed by extrusion are joined to each other to achieve seamlessness. In addition to these molding methods, molding may also be carried out using a hot press or an injection mold. The film thickness of the semiconducting film that will form the substrate layer is preferably from 30 μm to 150 μm.

A crystallization treatment is preferably carried out with the objective of improving the mechanical strength and durability of the intermediate transfer member. This crystallization treatment can be exemplified by an annealing treatment at a temperature that is at least the glass transition temperature (Tg) of the resin used. Crystallization of the resin used can be promoted by the annealing treatment. Proceeding in this manner, an intermediate transfer member can be fabricated that not only has an excellent mechanical strength and durability, but is also excellent in terms of the wear resistance, chemical resistance, sliding properties, toughness, and flame retardancy.

The intermediate transfer member used by the present invention can be confirmed to have an excellent mechanical strength by performing tensile testing in accordance with JIS K 7113. The tensile elastic modulus of the intermediate transfer member is preferably at least 1.5 GPa, more preferably at least 2.0 GPa, and even more preferably at least 2.5 GPa. The tensile elongation at break of the intermediate transfer member is preferably at least 10% and is more preferably at least 20%. JIS P 8115 is known for bending fatigue testing, and excellent properties can also be confirmed thereby.

[The Surface Layer Formation Method]

The surface layer of the intermediate transfer member can be formed by the following method.

The surface layer can be formed through (1) a mixing step of obtaining a mixture by mixing PFPE, the polymerizable monomer for forming the binder resin, and optionally a dispersing agent and a polymerization initiator;

(2) a coating step of coating the mixture on the substrate layer; and (3) a polymerization step of polymerizing the polymerizable monomer in the mixture.

First, a mixture is obtained in the mixing step (1) by mixing the PFPE, polymerizable monomer for forming the binder resin, and optionally a dispersing agent and a polymerization initiator, using a stirred homogenizer and an ultrasound homogenizer. The following may also be added to the mixture at this point: a solvent, a curing agent (for example, a UV curing agent), an electroconductive agent, and additives.

The solvent can be exemplified by methyl ethyl ketone (MEK), methyl isobutyl ketone (MIBK), and ethylene glycol.

The curing agent can be exemplified by photopolymerization initiators and thermal polymerization initiators.

The additives can be exemplified by electroconductive agents, filler particles, colorants, and leveling agents.

The mixture obtained in the mixing step (1) is then coated in the coating step (2) on the substrate layer using a coating method such as a bar coating method, spray coating method, ring coating method, and so forth. After coating has been performed, the obtained coating film is dried at a temperature of 60° C. to 90° C. to remove the solvent.

A curing polymerization of the polymerizable monomer in the coating film is then carried out in the polymerization step (3). The curing polymerization method can be exemplified by methods such as thermal curing, electron beam curing, and ultraviolet curing. In a preferred method, curing polymerization of the polymerizable monomer in the mixture is induced by the irradiation of ultraviolet radiation on the mixture coated on the substrate layer.

An intermediate transfer member according to the present invention can be obtained by going through these steps.

[The Method of Measuring the Microhardness]

The microhardness of the surface of the intermediate transfer member was measured in the present invention using an ultramicrohardness tester (product name: ENT-1100, from Elionix Inc.). A diamond triangular indenter with a dihedral angle of 115° was used in the ultramicrohardness tester and the microhardness was measured at a load of 50 mg.

[The Method of Measuring the Amount of Wear]

The amount of wear of the surface of the intermediate transfer member was measured using a Taber abrasion test based on JIS K 7204. A CS-17 abrasive wheel in a rotary abrasion tester (Toyo Seiki Seisaku-sho, Ltd.) was used for the test instrument, and the amount of mass loss produced by abrasion at a load of 4.9 N and rotation rate of 60 rpm was measured as the amount of wear.

[The Method of Measuring the Average Long Diameter of the Domains]

With regard to the average long diameter of the domains, the cross section of the surface layer of the intermediate transfer member was observed using an SEM (product name: S-4000, Hitachi High-Technologies Corporation).

The cross section of the surface layer of the intermediate transfer member was first sectioned out using a microtome (product name: EM UC7, from Leica Microsystems) to provide the samples used. At this point, cross section SEM images were used in which a minimum of at least 1 domain could be seen in a unit area of 15 $\mu m^2$ when the cross section was enlarged 20,000λ. The long diameters of all the domains in a field of view were measured in the case of 10 or fewer domains. In the case of more than 10, the long diameters of the domains were measured on 10 randomly selected domains. Using the same procedure, SEM observation of the cross section in different fields of view was carried out 10 times, and the average value of the domain long diameters measured on the SEM images in each of 10 cross sections was used as the average long diameter of the domains in the present invention.

[The Method of Measuring the Domain Area]

With regard to the area of the domains, the cross section of the surface layer of the intermediate transfer member was observed by SEM (product name: S-4800, Hitachi High-Technologies Corporation) using as the samples the same samples used to measure the average long diameter of the domains. Here, the proportion of the domain area was measured in a unit area of 15 $\mu m^2$ when the cross section was enlarged 20,000×. Using the same procedure, SEM observation of the cross section in different fields of view was carried out 10 times, and the average value of the proportions for the domain area measured on the SEM images in each of 10 cross sections was used as the proportion for the domain area of the domains in the present invention.

[The Method for Measuring the Contact Angle θ(A) Relative to Water of the Surface of the Photosensitive Member and the Contact Angle θ(B) Relative to Water of the Surface of the Intermediate Transfer Member]

A CA-X (product name) image processing-based contact angle meter from Kyowa Interface Science Co., Ltd. was used.

The measurement method is as follows.

A surface section was sliced out with a cutter from the surface of the photosensitive member or the surface of the intermediate transfer member and was fixed on the sample stand. A pure water liquid drop was formed on the surface of the sample by feeding pure water from the tip of the liquid drop supply needle. The coordinates of the left edge, right edge, and apex angle of this water drop were determined by image processing, and the contact angle was determined using the following formula from the calculated diameter (2r) and height (h) of the water drop.

$$\omega = 2\tan^{-1}(h/r)$$

θ(A) in the present invention is preferably from 70° to 100° and is more preferably from 80° to 95°.

A high durability with respect to external mechanical forces is a feature required of the photosensitive member. The hardness of the film is higher as the amount of deformation produced by external stresses is lower.

The strength of the surface of the photosensitive member is substantially improved by having the universal hardness value (HU) be from 150 $N/mm^2$ to 220 $N/mm^2$ when the photosensitive member is subjected to hardness testing using a Vickers four-sided pyramidal diamond indenter and indentation at a maximum load of 6 mN.

The universal hardness value (HU) of the surface of the photosensitive member is preferably 150 $N/mm^2$ to 220 $N/mm^2$ and is more preferably 170 $N/mm^2$ to 200 $N/mm^2$. When HU exceeds 220 $N/mm^2$, a locally large pressure is exerted by the paper dust and toner sandwiched by, for example, the charging roller, and deep scratches then tend to be produced. When, on the other hand, HU is less than 150 $N/mm^2$, abrasion and/or the production of fine scratches tends to occur due to rubbing of the paper dust and toner sandwiched by the charging roller.

When radiation curing is used during the formation of the surface layer of the photosensitive member, the HU of the surface of the photosensitive member can be controlled using the radiation exposure conditions.

The photosensitive member according to the present invention preferably has a protective layer.

This protective layer preferably contains a compound (cured material) that has undergone curing by the polymerization and/or crosslinking of a hole transport compound that has one or more chain polymerizable functional groups within the same molecule. A hole transport compound that has a chain polymerizable functional group denotes a compound in which a chain polymerizable functional group is chemically bonded to a moiety of a hole transport compound. The details are described in Japanese Patent Application Laid-open No. 2000-66424. More preferably two or more chain polymerizable functional groups are present in the same molecule. The acryloyloxy group ($CH_2{=}CHCOO{-}$) and methacryloyloxy group ($CH_2{=}C(CH_3)COO{-}$) are preferred as the chain polymerizable functional group.

In the present invention, the universal hardness value (HU) and the elastic deformation ratio of the surface of the photosensitive member are the values measured using a microhardness measurement instrument (product name: Fischerscope H100V from Fischer Technology, Inc.) in a 25° C./50% RH environment. The Fischerscope H100V is an instrument that determines the continuous hardness by contacting the indenter with the measurement target (the surface of the photosensitive member), continuously applying a load to the indenter, and directly reading the depth of indentation under the load.

For the present invention, a Vickers four-sided pyramid diamond indenter with a face-to-face angle of 136° was used as the indenter; the end for the load continuously applied to the indenter (final load) was made 6 mN when the measurement target was the photosensitive member; and the time of retention of the application of the final load of 6 mN to the indenter (retention time) was 0.1 seconds. 273 measurement points were used.

Figure 4:
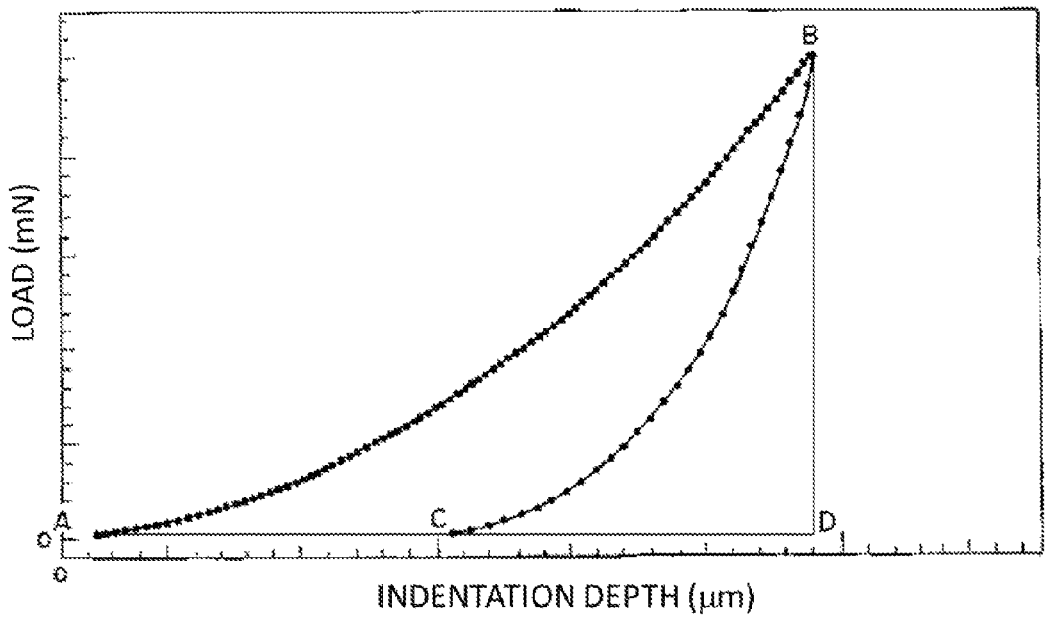
FIG. 4 is a model diagram of an output chart obtained with a microhardness measurement apparatus.

A model output chart from this microhardness measurement instrument is given in FIG. 4.

In FIG. 4, the vertical axis gives the load F (mN) applied to the indenter and the horizontal axis gives the depth h (μm) of indentation by the indenter. FIG. 4 shows the results when the load applied to the indenter is increased stepwise to reach a maximum load (A→B) followed by a stepwise reduction in the load (B→C). FIG. 4 shows the results for a stepwise increase in the load applied to the indenter to a final load of 6 mN followed by a stepwise reduction in the load.

The universal hardness value (HU) can be determined using the following formula from the indentation depth of the indenter when the final load of 6 mN has been applied to the indenter.

$$HU = \frac{F_f\ (N)}{S_r\ (\mathrm{mm}^2)} = \frac{6\times10^{-3}}{26.43\times(h_f\times10^{-3})^2}$$

(In this formula, HU ($N/mm^2$) is the universal hardness value; Ff (N) refers to the final load; Sr ($mm^2$) refers to the surface area of the indented part of the indenter when the final load has been applied; and hf (μm) refers to the indentation depth of the indenter when the final load has been applied.)

The elastic deformation ratio can be determined from the change in the amount of work (energy) done by the indenter on the measurement target (the surface of the photosensitive member), i.e., in the energy due to the increase and reduction in the load by the indenter on the measurement target (the surface of the photosensitive member). Specifically, the value (We/Wt) obtained by dividing the amount of elastic deformation work We by the total amount of work Wt is the elastic deformation ratio. The total amount of work Wt is the area of the region bounded by A-B-D-A in FIG. 4, while the amount of elastic deformation work We is the area of the region bounded by C-B-D-C in FIG. 4.

When a photosensitive member having a high surface hardness as described above is used for the photosensitive member according to the present invention, the wear resistance is improved while the cleaning performance may in some cases be reduced, and the surface of the photosensitive member is therefore preferably a surface that has been roughened. In specific terms, the surface roughness Rz (10-point mean surface roughness) of the photosensitive member is preferably from 0.2 μm to 3.0 μm. In addition, the mean spacing of profile irregularities Sm for the surface of the photosensitive member is preferably from 10 μm to 100 μm. The kurtosis RKu of the surface of the photosensitive member is also preferably greater than 3 and less than 20.

When Rz is less than 0.2 μm, a large area of contact between the cleaning blade and the surface of the photosensitive member is produced and cleaning blade vibration and cleaning blade wear and chipping readily occur. As a result, the maintenance of an excellent cleaning performance can become problematic as the number of prints adds up. When Sm is larger than 100 μm, a high adhesion occurs between the cleaning blade and the surface of the photosensitive member and the maintenance of an excellent cleaning performance again can become problematic as the number of prints adds up. When, on the other hand, Rz is larger than 3 μm or Sm is smaller than 10 μm, the cleaning blade does not come into adequate contact with the surface of the photosensitive member and little effect with regard to stopping untransferred toner may be obtained and slip-through by the toner can readily occur.

The surface roughness of the surface of the photosensitive member was measured in the present invention as follows using a contact-type surface roughness analyzer (product name: Surfcorder SE3500 from Kosaka Laboratory Ltd.).

detector: 0.7 mN diamond stylus with R=2 μm
filter: 2CR
cutoff value: 0.8 mm
measurement length: 2.5 mm
traverse speed: 0.1 mm/s The data under these conditions was processed for the 10-point mean surface roughness Rz defined in JIS B 0601. The mean spacing of profile irregularities Sm of the surface of the photosensitive member was also measured under the same conditions as for Rz and the arithmetic mean value obtained from the following formula was taken to be Sm.

$$Sm = \frac{1}{n}\sum_{i=1}^{n} Smi$$

(In this formula, Smi denotes the spacing between profile irregularities and n denotes the number of spacings between profile irregularities within the reference length.)

The support for the photosensitive member should exhibit electroconductivity (electroconductive support) and can be exemplified by supports of a metal, e.g., aluminum, copper, chromium, nickel, zinc, stainless steel, and so forth, or of an alloy of the preceding. The shape of the support can be exemplified by drum shapes, belt shapes, and so forth.

An undercoat layer having a barrier function and/or an adhesive function may be disposed on the support.

The undercoat layer is formed in order to improve the adhesiveness for the photosensitive layer, improve the coatability, protect the support, cover defects in the support, improve the charge injection performance from the support, and protect against the electrical breakdown of the photosensitive layer.

The material of the undercoat layer can be exemplified by polyvinyl alcohol, poly-N-vinylimidazole, polyethylene oxide, ethyl cellulose, ethylene-acrylic acid copolymer, casein, polyamide, N-methoxymethylated nylon 6, copolymer nylon, glue, and gelatin.

The undercoat layer can be formed by the application to the support of an undercoat layer coating solution prepared by the dissolution in a solvent of the aforementioned material.

The film thickness of the undercoat layer is preferably from 0.1 μm to 2 μm.

The photosensitive layer of the photosensitive member may be a so-called monolayer photosensitive layer that contains a charge generation material and a charge transport material in one and the same layer, or may be a so-called function-separated (stacked) photosensitive layer in which the functionalities are separated into a charge generation layer containing a charge generation material and a charge transport layer containing a charge transport material.

The charge generation material used in the photosensitive layer (charge generation layer) can be exemplified by selenium-tellurium and pyrylium and thiapyrylium dyes. Other examples are phthalocyanine pigments having various central metals and various crystalline forms (for example, crystalline forms such as α, β, γ, ϵ, and X), anthanthrone pigments, dibenzpyrenequinone pigments, pyranthrone pigments, azo pigments (trisazo pigments, disazo pigments, monoazo pigments), indigo pigments, quinacridone pigments, asymmetric quinocyanine pigments, quinocyanine, and amorphous silicon.

The charge generation layer can be formed as follows when the photosensitive layer is a function-separated (stacked) photosensitive layer. Thus, formation can be carried out by preparing a charge generation layer coating liquid by carrying out a dispersion treatment on the charge generation material, a binder resin in an amount that is from 0.3-times to 4-times that of the charge generation material, and solvent; forming a coating film by applying the charge generation layer coating liquid; and drying the coating film. The dispersion treatment method can be exemplified by methods that use, for example, a homogenizer, ultrasound dispersion, ball mill, vibrating ball mill, sand mill, attritor, roll mill, and so forth. A vapor-deposited film of a charge generation material may also be used as the charge generation layer.

The film thickness of the charge generation layer is preferably not more than 3 μm and is more preferably from 0.1 μm to 2 μm.

The binder resin for the charge generation layer can be exemplified by the polymers or copolymers of vinyl compounds such as styrene, vinyl acetate, vinyl chloride, acrylate esters, methacrylate esters, vinylidene fluoride, and trifluoroethylene, and by polyvinyl alcohol, polyvinyl acetal, polycarbonate, polyester, polysulfone, polyphenylene oxide, polyurethane, cellulosic resins, phenolic resins, melamine resins, silicon resins, and epoxy resins.

The charge transport material used in the photosensitive layer (charge transport layer) can be exemplified by polymer compounds that contain a heterocycle or a condensed polycyclic aromatic system, such as poly-N-vinylcarbazole and polystyrylanthracene, and by low molecular weight compounds such as heterocyclic compounds such as pyrazoline, imidazole, oxazole, triazole, and carbazole, triarylalkane derivatives such as triphenylmethane, triarylamine derivatives such as triphenylamine, phenylenediamine derivatives, N-phenylcarbazole derivatives, stilbene derivatives, and hydrazone derivatives.

The charge transport layer can be formed as follows when the photosensitive layer is a function-separated (stacked) photosensitive layer. Thus, formation can be carried out by preparing a charge transport layer coating liquid by dissolving the charge transport material and optionally a binder in a solvent; forming a coating film by applying the charge transport layer coating liquid; and drying the coating film. The ratio between the charge transport material and the binder resin, using 100 mass parts for the total mass of the two, is preferably from 20 mass parts to 100 mass parts of the charge transport material and more preferably from 30 mass parts to 100 mass parts of the charge transport material. When the amount of the charge transport material is too small, the charge transport capacity declines and, for example, a decline in sensitivity and an increase in the residual potential may readily occur.

The binder resin for the charge transport layer can be exemplified by the polymers or copolymers of vinyl compounds such as styrene, vinyl acetate, vinyl chloride, acrylate esters, methacrylate esters, vinylidene fluoride, and trifluoroethylene, and by polyvinyl alcohol, polyvinyl acetal, polycarbonate, polyester, polysulfone, polyphenylene oxide, polyurethane, cellulosic resins, phenolic resins, melamine resins, silicon resins, and epoxy resins.

When the photosensitive layer is a monolayer photosensitive layer, the monolayer photosensitive layer can be formed by preparing a photosensitive layer coating liquid by dispersing and/or dissolving a charge generation material as described above and a charge transport material as described above in a binder as described above; forming a coating film by applying the photosensitive layer coating liquid; and drying the coating film.

A protective layer may also be disposed on the photosensitive layer.

The protective layer can be formed as follows when the protective layer contains a compound that undergoes curing through the polymerization and/or crosslinking of a hole transport compound that has a chain polymerizable functional group. Thus, formation can be carried out by the formation of a coating film by the application of a protective layer coating liquid that contains a hole transport compound that has a chain polymerizable functional group, followed by the polymerization and/or crosslinking of the hole transport compound that has a chain polymerizable functional group.

The method for applying the coating liquids for these layers can be exemplified by dip coating methods, spray coating methods, curtain coating methods, spin coating methods, and so forth. Among these, dip coating methods are preferred from the standpoints of the efficiency and productivity. The layers may also be formed by vapor-deposition film-forming methods and plasma-based film-forming methods.

The hole transport compound that has a chain polymerizable functional group can be polymerized and/or crosslinked by heat, light such as visible light or ultraviolet light, or radiation, e.g., an electron beam. Thus, such a hole transport compound and optionally a polymerization initiator may be incorporated in the coating liquid and this hole transport compound can be polymerized and/or crosslinked by exposing the coating film from this coating liquid to heat, light, and/or radiation.

The polymerization and/or crosslinking (curing) of the hole transport compound that has a chain polymerizable functional group is preferably brought about in the present invention using radiation. The universal hardness value (HU) and the elastic deformation ratio of the surface of the photosensitive member can be controlled using the radiation exposure conditions. An advantage to radiation-induced polymerization is that it does not necessarily require a polymerization initiator. By avoiding the use of a polymerization initiator, a protective layer of a very pure three-dimensional matrix is formed and excellent electrophotographic properties are obtained. The electron beam and γ-radiation are preferred for the radiation used, while the electron beam is more preferred. In the case of exposure to an electron beam, the accelerator can be exemplified by scanning types, electrocurtain types, broad beam types, pulse types, and laminar types. When exposure to an electron beam is used, the electron beam exposure conditions are preferably controlled considering the electrophotographic properties and the durability.

When exposure to an electron beam is used, the acceleration voltage is preferably not more than 250 kV and is more preferably not more than 150 kV. The irradiation dose is preferably from 0.1 Mrad to 100 Mrad and is more preferably from 0.5 Mrad to 20 Mrad. The electrophotographic properties of the photosensitive member are readily impaired by exposure to the electron beam when the acceleration voltage is too high. Curing readily becomes inadequate when the irradiation dose is too low, while the electrophotographic properties of the photosensitive member are readily impaired when the irradiation dose is too large.

The application of heat during the electron beam exposure-induced polymerization reaction is preferred in order to bring about a more thorough cure. With regard to the timing of heat application, the photosensitive member should be brought to a certain temperature during the interval in which radicals produced by electron beam irradiation are present, and thus heat may be applied prior to, during, or after exposure to the electron beam; however, after exposure is preferred. Heating is preferably carried out so as to bring the temperature of the photosensitive member into the range from room temperature (25° C.) to 250° C. and more preferably into the range from 50° C. to 150° C. When the temperature is too high, the materials used in the photosensitive member are then vulnerable to deterioration and the electrophotographic properties then readily decline. The heating time is preferably from approximately several seconds to several tens of minutes. The atmosphere during electron beam irradiation and heating is preferably the atmosphere, or an inert gas such as nitrogen or helium, or a vacuum. Execution in an inert gas or a vacuum is more preferred from the standpoint of inhibiting the radical deactivation that is brought about by oxygen.

The film thickness of the protective layer is preferably from 3 μm to 10 μm.

The toner used in the image-forming method of the present invention is a toner that, when made into a pellet molding, exhibits a contact angle relative to water for a surface thereof of from 60° to 80°. From 65° to 75° is preferred. When the contact angle relative to water of the surface of the toner pellet molding exceeds 80°, the toner-to-toner attachment force is then too small and due to this the toner particle clusters are disrupted during transfer and the formation of a uniform toner layer is impeded. In addition, when the contact angle relative to water of the surface of the toner pellet molding is less than 60°, problems such as fogging are prone to occur due to excessive toner aggregation. When the development means has a developing roller, coating problems readily occur at the surface of the developing roller.

The toner particle according to the present invention contains a binder resin.

The toner particle preferably further contains a wax and a polymer having a structure provided by the reaction of a vinylic resin component with a hydrocarbon compound (preferably a polyolefin).

The present inventors have discovered that an excellent primary transfer from the photosensitive member to the intermediate transfer member is produced by incorporating in the toner particle a polymer having a structure provided by the reaction of a vinylic resin component with a hydrocarbon compound and executing a heat treatment (hot air current treatment) on this toner particle. It was found that this results in a high in-plane uniformity and enables the long-term output of an image having a high density stability. The mechanism here is unclear, but the present inventors hypothesize the following.

By the incorporation in the toner particle of wax and a polymer having a structure provided by the reaction of a vinylic resin component with a hydrocarbon compound and executing a heat treatment on this toner, the migration rate of the wax in the surface direction of the toner particle can be controlled and the distribution of the wax can be skewed toward the surface of the toner particle. The formation of this surface structure facilitates control of the contact angle relative to water of the surface of the toner pellet molding to from 60° to 80°. As a result, the toner is aggregated by the pressure applied during transfer from the photosensitive member to the intermediate transfer member and a uniform toner layer can be formed on the surface of the intermediate transfer member.

In addition, at the time of primary transfer of the toner to the intermediate transfer member, the toner is pressed by high pressure to the intermediate transfer member and as a result assumes a consolidated state. When, during the ensuing secondary transfer from the intermediate transfer member to the transfer material, there is a high particle-to-particle attachment force for the consolidated toner and a low attachment force between the intermediate transfer member and the toner particles, the clusters of consolidated toner particles are not broken up and separation from the intermediate transfer member occurs easily and as a consequence little toner remains on the surface of the intermediate transfer member.

Thus, control of the contact angle relative to water of the surface of the toner pellet molding to from 60° to 80° is facilitated by the incorporation in the toner particle of wax and a polymer having a structure provided by the reaction of a vinylic resin component with a hydrocarbon compound and executing a heat treatment on this toner particle. In addition, the contact angle relative to water of the surface of the toner pellet molding can also be controlled through adjustment of, for example, the content of the wax and the temperature of the heat treatment (hot air current treatment). A uniform toner layer can be formed on the intermediate transfer member from the photosensitive member by using a toner having a controlled contact angle relative to water for the surface of the toner pellet molding. Moreover, a uniform transferability can be maintained by increasing the particle-to-particle attachment force of the toner and suppressing internal collapse. The present inventors think that this effect can be exhibited regardless of the smoothness of the transfer material and that this effect is exhibited to a substantial degree for the combination with an intermediate transfer member that has a low attachability for toner.

[The Resin]

The binder resin used in the toner particle according to the present invention can be exemplified by the homopolymers of styrene and substituted styrenes, e.g., polystyrene, poly-p-chlorostyrene, and polyvinyltoluene; styrenic copolymers such as styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; polyvinyl chloride; phenolic resins; natural modified phenolic resins; natural resin-modified maleic acid resins; acrylic resins; methacrylic resins; polyvinyl acetate; silicone resins; polyester resins; polyurethane; polyamide resins; furan resins; epoxy resins; xylene resins; polyvinyl butyral; terpene resins; coumarone-indene resins; and petroleum resins.

Polyester resins are preferred among the preceding from the standpoint of control of the low-temperature fixability and charging performance.

Here, polyester resin refers to a resin that has a "polyester unit" in the resin chain. The components constituting this polyester unit can be exemplified by dihydric and higher hydric alcohol monomer components and acid monomer components that are at least dibasic, such as at least dibasic carboxylic acids, at least dibasic carboxylic anhydrides and at least dibasic carboxylate esters.

The dihydric and higher hydric alcohol monomer components can be exemplified by alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, and by ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Aromatic diols are preferred among the preceding for the alcohol monomer component. Aromatic diol-derived units are preferably present in a proportion of at least 80 mol % in the alcohol monomer component-derived units that constitute the polyester resin.

The at least dibasic acid monomer component can be exemplified by aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acids substituted by a $C_{6-18}$ alkyl group or alkenyl group, and their anhydrides; and unsaturated dicarboxylic acids such as fumaric acid, maleic acid, and citraconic acid, and their anhydrides.

The following are preferred among the preceding for the acid monomer component: polybasic acids such as terephthalic acid, succinic acid, adipic acid, fumaric acid, trimellitic acid, pyromellitic acid, and benzophenonetetracarboxylic acid and their anhydrides.

Viewed from the perspective of the stability of the triboelectric charge quantity, the acid value of the polyester resin is preferably from 1 mg KOH/g to 20 mg KOH/g.

The acid value of a resin can be adjusted by adjusting the type and amount of addition of the monomer used to produce the resin. For the example of a polyester resin, the acid value can be controlled by adjusting the alcohol monomer component ratio/acid monomer component ratio during resin production, and/or by adjusting the molecular weight. The acid value may also be adjusted by reacting, after the ester condensation polymerization, terminal alcohol with a polybasic acid monomer (for example, trimellitic acid).

The aforementioned polymer having a structure provided by the reaction of a vinylic resin component with a hydrocarbon compound is preferably such a polymer in which the hydrocarbon compound is a polyolefin. The following are more preferred: graft polymers having a structure in which polyolefin is grafted to a vinylic resin component and graft polymers having a vinylic resin component in which a vinylic monomer is graft polymerized to a polyolefin.

This polymer having a structure provided by the reaction of a vinylic resin component with a hydrocarbon compound acts as a surfactant for the melted binder resin and wax during the kneading step and surface smoothing step during toner production. Accordingly, this polymer can control the average primary dispersed particle diameter of the wax in the toner particle and can control the wax migration rate to the surface of the toner particle when a heat treatment is carried out (surface treatment with a hot air current).

With regard to the aforementioned graft polymers having a structure in which polyolefin is grafted to a vinylic resin component and graft polymers having a vinylic resin component in which a vinylic monomer is graft polymerized to a polyolefin, the polyolefin here is a polymer or copolymer of an unsaturated hydrocarbon monomer that has a single double bond but is not otherwise particularly limited, and a wide range of polyolefins can be used. The use of a polyethylene or polypropylene is preferred in particular.

The vinylic monomer can be exemplified by the following: styrenic monomers such as styrene and its derivatives, e.g., styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; amino group-bearing α-methylene aliphatic monocarboxylate esters, e.g., dimethylaminoethyl methacrylate and diethylaminoethyl methacrylate; nitrogen atom-containing vinylic monomers such as derivatives of acrylic acid and methacrylic acid, e.g., acrylonitrile, methacrylonitrile, and acrylamide; unsaturated dibasic acids, e.g., maleic acid, citraconic acid, itaconic acid, alkenylsuccinic acid, fumaric acid, and mesaconic acid; unsaturated dibasic acid anhydrides, e.g., maleic anhydride, citraconic anhydride, itaconic anhydride, and alkenylsuccinic anhydride; the half esters of unsaturated dibasic acids, e.g., the methyl half ester of maleic acid, ethyl half ester of maleic acid, butyl half ester of maleic acid, methyl half ester of citraconic acid, ethyl half ester of citraconic acid, butyl half ester of citraconic acid, methyl half ester of itaconic acid, methyl half ester of alkenylsuccinic acid, methyl half ester of fumaric acid, and methyl half ester of mesaconic acid; esters of unsaturated dibasic acids, e.g., dimethyl maleate and dimethyl fumarate; α,β-unsaturated acids, e.g., acrylic acid, methacrylic acid, crotonic acid, and cinnamic acid; the anhydrides of α,β-unsaturated acids, e.g., crotonic anhydride and cinnamic anhydride, and anhydrides between an α,β-unsaturated acid and a lower fatty acid; carboxyl group-bearing vinylic monomers such as alkenylmalonic acid, alkenylglutaric acid, and alkenyladipic acid and their anhydrides and monoesters;

hydroxyl group-bearing vinylic monomers such as acrylate esters and methacrylate esters, e.g., 2-hydroxyethyl acrylate, 2-hydroxyethyl methacrylate, and 2-hydroxypropyl methacrylate, as well as 4-(1-hydroxy-1-methylbutyl) styrene and 4-(1-hydroxy-1-methylhexyl)styrene; acrylate ester such as acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and methacrylate esters such as α-methylene aliphatic monocarboxylate esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

The polymer having a structure provided by the reaction of a vinylic resin component with a hydrocarbon compound can be obtained by a method, for example, in which the aforementioned monomers are reacted with each other or in which the monomer of a first polymer is reacted with a second polymer.

The units in the vinylic resin component preferably include a styrene-derived unit and more preferably additionally include an acrylonitrile- and/or methacrylonitrile-derived unit.

The mass ratio between the hydrocarbon compound and the vinylic resin component (hydrocarbon compound/vinylic resin component) in this polymer is preferably from at least 1/99 to not more than 75/25. The use of the hydrocarbon compound and vinylic resin component in this range facilitates dispersion of the wax in the toner particle and facilitates control of the migration rate of the wax to the surface of the toner particle when the optional heat treatment (surface treatment with a hot air current) is carried out.

The content in the toner particle of the aforementioned polymer having a structure provided by the reaction of a vinylic resin component with a hydrocarbon compound is preferably from 0.2 mass parts to 20 mass parts per 100 mass parts of the binder resin. The weight-average molecular weight (Mw) of this polymer is preferably from 6,000 to 8,000 and its number-average molecular weight (Mn) is preferably from 1,500 to 5,000.

The use of this polymer with these ranges facilitates dispersion of the wax in the toner particle and facilitates control of the migration rate of the wax to the toner particle surface during the execution of the heat treatment (surface treatment with a hot air current).

[The Wax]

The toner particle according to the present invention may contain a wax.

This wax can be exemplified by hydrocarbon waxes such as low molecular weight polyethylenes, low molecular weight polypropylenes, alkylene copolymers, microcrystalline waxes, paraffin waxes, and Fischer-Tropsch waxes; oxides of hydrocarbon waxes such as oxidized polyethylene waxes, and their block copolymers; waxes in which the major component is a fatty acid ester, e.g., carnauba wax; fatty acid esters that have been partially or completely deacidified, e.g., deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters between a fatty acid such as palmitic acid, stearic acid, behenic acid, or montanic acid and an alcohol such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; aliphatic metal salts (generally referred to as metal soaps) such as calcium stearate, calcium laurate, zinc stearate, and magnesium stearate; waxes provided by grafting a vinylic monomer, e.g., styrene or acrylic acid, on an aliphatic hydrocarbon wax; partial esters between polyhydric alcohols and fatty acids, e.g., behenyl monoglyceride; and hydroxyl group-bearing methyl ester compounds obtained by the hydrogenation of vegetable oils.

Among these waxes, hydrocarbon waxes such as paraffin waxes and Fischer-Tropsch waxes are preferred from the standpoint of improving the low-temperature fixability and improving the resistance to wrap-around during fixing (suppression of wrap-around by the transfer material during fixing).

The content of the wax in the toner particle is preferably from 0.5 mass parts to 20 mass parts per 100 mass parts of the binder resin.

From the perspective of having the toner storability coexist in good balance with the resistance to hot offset, the peak temperature of the maximum endothermic peak present in the temperature range from 30° C. to 200° C., in the endothermic curve during temperature ramp up as measured using a differential scanning calorimeter (DSC), is preferably from 50° C. to 110° C.

[The Colorant]

The toner particle according to the present invention may contain a colorant. A pigment or a dye may be used by itself as the colorant, but the use of a dye/pigment combination to enhance the sharpness is the preferred case from the perspective of the image quality of the full-color image.

The colorant can be exemplified by the following.

The black colorant can be exemplified by carbon black and colorant adjusted to black using a yellow colorant, a magenta colorant, and a cyan colorant.

Among magenta colorants, the pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; and C. I. Vat Red 1, 2, 10, 13, 15, 23, 29, and 35.

Among magenta colorants, the dyes can be exemplified by oil-soluble dyes such as C. I. Solvent Red 1, 3, 8, 23, 24, 25, 27, 30, 49, 81, 82, 83, 84, 100, 109, and 121; C. I. Disperse Red 9; C. I. Solvent Violet 8, 13, 14, 21, and 27; and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28.

Among cyan colorants, the pigments can be exemplified by C. I. Pigment Blue 2, 3, 15:2, 15:3, 15:4, 16, and 17; C. I. Vat Blue 6; C. I. Acid Blue 45; and copper phthalocyanine pigments in which from 1 to 5 phthalimidomethyl groups are substituted on the phthalocyanine skeleton.

Among cyan colorants, the dyes can be exemplified by C. I. Solvent Blue 70.

Among yellow colorants, the pigments can be exemplified by C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and by C. I. Vat Yellow 1, 3, and 20.

Among yellow colorants, the dyes can be exemplified by C. I. Solvent Yellow 162.

The colorant content in the toner particle is preferably from 0.1 mass parts to 30 mass parts per 100 mass parts of the binder resin.

[The Charge Control Agent]

The toner particle according to the present invention may contain a charge control agent (CA agent). The charge control agent incorporated in the toner particle is preferably a metal aromatic carboxylate compound that is colorless, that has a high charging speed for the toner, and that can maintain a constant or prescribed amount of charge on a stable basis.

Negative-charging charge control agents can be exemplified by metal salicylate compounds, metal naphthoate compounds, metal dicarboxylate compounds, polymer compounds having sulfonic acid or carboxylic acid in side chain position, polymer compounds having a sulfonate salt or sulfonate ester in side chain position, polymer compounds having a carboxylate salt or carboxylate ester in side chain position, boron compounds, urea compounds, silicon compounds, and calixarene.

The charge control agent may be internally added to the toner particle or may be externally added to the toner particle.

The content of the charge control agent in the toner particle is preferably from 0.2 mass parts to 10 mass parts per 100 mass parts of the binder resin.

[External Additives]

The toner according to the present invention may further have, in addition to toner particles, an external additive in order to enhance the flowability and/or adjust the triboelectric charge quantity.

The external additive can be exemplified by finely divided inorganic particles of, e.g., silicon oxide (silica), titanium oxide, aluminum oxide, or strontium titanate.

The finely divided inorganic particles used for the external additive are preferably subjected to a hydrophobic treatment with a hydrophobic agent such as, for example, a silane compound, silicone oil, or their mixture.

Viewed from the perspective of preventing the external additive from becoming buried, the specific surface area of the external additive is preferably from 10 $m^2/g$ to 50 $m^2/g$.

The content of the external additive in the toner is preferably from 0.1 mass parts to 5.0 mass parts per 100 mass parts of the toner particles.

Mixing of the toner particles with the external additive can use, for example, a mixer such as a Henschel mixer.

Viewed from the perspective of obtaining a stable image on a long-term basis, the toner according to the present invention is preferably mixed with a magnetic carrier and used as a two-component developer.

The magnetic carrier can be exemplified by surface-oxidized iron powder; unoxidized iron powder; metal particles of, e.g., iron, lithium, calcium, magnesium, nickel, copper, zinc, cobalt, manganese, a rare earth, and so forth, and particles of their alloys; oxide particles; magnetic bodies such as ferrite; and magnetic body-dispersed resin carriers (so-called resin carriers) that contain a magnetic body and a binder resin that holds the magnetic body in a dispersed state.

[The Production Method]

Various production methods can be used for the method of producing the toner according to the present invention.

A toner production method that uses a pulverization method is described in the following as an example.

In a starting material mixing step, the materials that constitute the toner particle, for example, components such as the binder resin and as necessary wax, colorant, and charge control agent, are weighed out in prescribed amounts and mixed. The mixer can be exemplified by double-cone mixers, V-mixers, drum mixers, supermixers, Henschel mixers, Nauta mixers, and the Mechano Hybrid (Nippon Coke & Engineering Co., Ltd.).

The mixed materials are then subjected to melt-kneading to effect dispersion of components such as the wax in the binder resin.

The kneading equipment used in the melt-kneading step can be exemplified by batch kneaders such as pressure kneaders and Banbury mixers and by continuous kneaders. Single-screw and twin-screw extruders are preferred from a continuous production standpoint.

The kneading equipment can be exemplified by the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.).

The resin composition yielded by melt-kneading may be rolled out using, for example, a two-roll mill, and cooled with, for example, water.

The cooled resin composition is then pulverized to the desired particle diameter. In this pulverization step, for example, a coarse pulverization may be performed using a mill followed by a fine pulverization using a pulverizer. The mill can be exemplified by crushers, hammer mills, and feather mills. The pulverizer can be exemplified by the Krypton System (Kawasaki Heavy Industries, Ltd.), Super Rotor (Nisshin Engineering Inc.), and Turbo Mill (Turbo Kogyo Co., Ltd.) and by air jet systems.

The toner particle is then obtained as necessary by carrying out classification using a sieving apparatus or a classifier. The sieving apparatus or classifier can be exemplified by an internal classification system such as the Elbow Jet (Nittetsu Mining Co., Ltd.) and by centrifugal classification systems such as the Turboplex (Hosokawa Micron Corporation), TSP Separator (Hosokawa Micron Corporation), and Faculty (Hosokawa Micron Corporation).

A heat treatment is preferably carried out in the present invention on the resulting (pre-heat treatment) toner particle in order to perform a sphering treatment thereon. The toner particle can be efficiently sphered by carrying out a sphering heat treatment on the toner particle.

The heat-treatment (heat-sphering treatment) method can be exemplified by a method that carries out a thermal surface treatment using the surface treatment apparatus shown in FIG. 1.

In FIG. 1, a mixture (for example, the toner particles to be subjected to the heat treatment) metered and fed by a starting material metering and feed means 101 is conducted, by a compressed gas adjusted by compressed gas adjustment means 102, to an introduction tube 103 that is disposed on the vertical line of starting material feed means. The mixture that has passed through the introduction tube is uniformly dispersed by a conical projection member 104 that is disposed at the center of the starting material feed means and is introduced into an 8-direction feed tube 105 that extends radially and is introduced into a treatment compartment 106 in which the heat treatment is performed.

At this point, the flow of the mixture fed into the treatment compartment is regulated by regulation means 109 that is disposed within the treatment compartment in order to regulate the flow of the mixture. As a result, the mixture fed into the treatment compartment is heat treated while rotating within the treatment compartment and is thereafter cooled.

The heat for carrying out the heat treatment of the introduced mixture is itself fed from hot air current feed means 107 and is distributed by distribution means 112, and the hot air current is introduced into the treatment compartment having been caused to undergo a spiral rotation by a rotation member 113 for imparting rotation to the hot air current. With regard to its structure, the rotation member 113 for imparting rotation to the hot air current has a plurality of blades, and the rotation of the hot air current can be controlled using their number and angle. The hot air current fed into the treatment compartment has a temperature at the outlet of the hot air current feed means 107 of preferably from 100° C. to 300° C. and more preferably from 130° C. to 170° C. Variability may be produced in the surface roughness of the surface of the toner particle when the hot air current temperature is too low. When the temperature of the hot air current is too high, the molten state becomes overly developed and due to this the toner particles may coalesce with each other and coarsening of the toner particles and melt adhesion of the toner particles may then occur. When the temperature at the outlet of the hot air current feed means resides in the indicated range, the sphering treatment of the toner particles can be uniformly carried out while the melt adhesion and coalescence of the toner particles induced by an excessive heating of the mixture can be suppressed. The hot air current is fed from hot air current feed means outlet 111.

The toner particle that has been heat treated (heat-treated toner particle) is cooled by a cold air current fed from cold air current feed means 108. The temperature fed from the cold air current feed means 108 is preferably from −20° C. to 30° C. When the cold air current temperature resides in this range, the heat-treated toner particle can be efficiently cooled and melt adhesion and coalescence of the heat-treated toner particle can be suppressed without impairing the uniform sphering treatment of the mixture. The absolute amount of moisture in the cold air current is preferably from 0.5 g/m$^3$ to 15.0 g/m$^3$.

The cooled heat-treated toner particle is recovered by recovery means 110 residing at the lower end of the treatment compartment. A blower (not shown) is disposed at the end of the recovery means and thereby forms a structure that carries out suction transport.

A powder particle feeding port 114 is disposed so that the rotational direction of the incoming mixture is the same direction as the rotational direction of the hot air current, and the recovery means 110 of the surface treatment apparatus is disposed at the periphery of the treatment compartment so as to maintain the rotational direction of the rotating toner particles. The cold air current fed from the cold air current feed means 108 is configured to be fed from a horizontal tangential direction from the periphery of the apparatus to the circumferential surface within the treatment compartment. The rotational direction of the pre-heat-treatment toner particles fed from the powder feeding port, the rotational direction of the cold air current fed from the cold air current feed means, and the rotational direction of the hot air current fed from the hot air current feed means are all the same direction. As a consequence, flow perturbations within the treatment compartment are suppressed, the rotational flow within the apparatus is reinforced, a strong centrifugal force is applied to the toner particles prior to the heat treatment, and the dispersibility of the toner particles prior to the heat treatment is enhanced, as a result of which there are few coalesced particles and a heat-treated toner particle with a uniform shape can be obtained.

This is followed as necessary by the addition with mixing (external addition) of an external additive, e.g., finely divided inorganic particles, resin particles, and so forth, in order to impart flowability and improve the charging stability, thus yielding the toner.

The mixing apparatus can be, for example, a mixing apparatus that has a stirring member-equipped rotating member and a main casing disposed to provide a clearance with the stirring member.

The mixing apparatus can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation). In particular, the use is preferred of the Henschel mixer (Mitsui Mining Co., Ltd.) in order to provide uniform mixing and break up aggregates of the external additive (e.g., silica).

During mixing, for example, the amount treated, the rotation rate of the stirring axle, the stirring time, the shape of the stirring blades, the temperature within the chamber, and so forth can be controlled in order to obtain the properties desired for the toner.

In addition, for example, a sieve may be used as necessary when, for example, coarse aggregates of the additives are present free in the obtained toner.

The toner according to the present invention is preferably a toner that has a toner particle and an external additive, wherein the toner particle contains a binder resin (preferably a polyester resin) and a wax (preferably a hydrocarbon wax) and the toner satisfies the relationship in the following formula (2)

$$1.05 \leq P1/P2 \leq 2.00 \quad (2)$$

(in formula (2), P1=Pa/Pb and P2=Pc/Pd) where Pa is the maximum absorption peak intensity in the range from 2,843 cm$^{-1}$ to 2,853 cm$^{-1}$ and Pb is the maximum absorption peak intensity in the range from 1,713 cm$^{-1}$ to 1,723 cm$^{-1}$, in the FT-IR spectrum measured using the ATR method, Ge for the ATR crystal, and an angle of incidence for the infrared radiation of 45°, and Pc is the maximum absorption peak intensity in the range from 2,843 cm$^{-1}$ to 2,853 cm$^{-1}$ and Pd is the maximum absorption peak intensity in the range from 1,713 cm$^{-1}$ to 1,723 cm$^{-1}$, in the FT-IR spectrum measured using the ATR method, KRS5 for the ATR crystal, and an angle of incidence for the infrared radiation of 45°.

The maximum absorption peak intensity Pa is the value provided by subtracting the average value of the absorption peak intensities at 3,050 cm$^{-1}$ and 2,600 cm$^{-1}$ from the maximum value of the absorption peak intensity in the range from 2,843 cm$^{-1}$ to 2,853 cm$^{-1}$.

The maximum absorption peak intensity Pb is the value provided by subtracting the average value of the absorption peak intensities at 1,763 cm$^{-1}$ and 1,630 cm$^{-1}$ from the maximum value of the absorption peak intensity in the range from 1,713 cm$^{-1}$ to 1,723 cm$^{-1}$.

The maximum absorption peak intensity Pc is the value provided by subtracting the average value of the absorption peak intensities at 3,050 cm$^{-1}$ and 2,600 cm$^{-1}$ from the maximum value of the absorption peak intensity in the range from 2,843 cm$^{-1}$ to 2,853 cm$^{-1}$.

The maximum absorption peak intensity Pd is the value provided by subtracting the average value of the absorption peak intensities at 1,763 cm$^{-1}$ and 1,630 cm$^{-1}$ from the maximum value of the absorption peak intensity in the range from 1,713 cm$^{-1}$ to 1,723 cm$^{-1}$.

P1 is an index for the wax-to-binder resin abundance ratio for approximately 0.3 μm from the toner particle surface considered in the depth direction of the toner particle from the toner particle surface toward the center of the toner particle. P2 is an index for the wax-to-binder resin abundance ratio for approximately 1.0 μm from the toner particle surface.

The index (P1) for the wax-to-binder resin abundance ratio for approximately 0.3 μm from the toner particle surface is in the present invention preferably larger than the index (P2) for the wax-to-binder resin abundance ratio for approximately 1.0 μm from the toner particle surface. That is, the index ratio [P1/P2] for these abundance ratios (i.e., the degree of skew in the occurrence of the wax in the depth direction of the toner particle from the toner particle surface toward the center of the toner particle) is preferably controlled.

A uniform toner layer can be formed at the time of transfer at the surface of the photosensitive member and the surface of the intermediate transfer member by controlling [P1/P2] into the indicated range.

[P1/P2] is preferably from 1.10 to 1.70 and more preferably from 1.15 to 1.65.

[P1/P2] has been less than 1.00 for conventional pulverized toners (toners produced by a pulverization method) that have not been subjected to a heat sphering and for polymerized toners (toners produced by a polymerization method), and it has been necessary to add large amounts of wax in order to improve the fixing separation behavior. As a result, large fluctuations have occurred in the triboelectric charge quantity due to burying and detachment of external additives and density fluctuations and white background fogging have ended up being produced.

In addition, the value of [P1/P2] changes with the degree of sphering in heat-sphered conventional toners. However, with heat-sphered conventional toners, the wax has immediately come out to the toner particle surface at a small amount of heat and the value of [P1/P2] has ended up exceeding 2.00 before the toner particle has undergone a satisfactory sphering.

In FT-IR spectra the absorption peak in the range from 1,713 $cm^1$ to 1,723 $cm^{-1}$ is a peak generated mainly by the stretching vibration of the —(C═O)— originating from the binder resin.

Various peaks other than this can be detected as binder resin-derived peaks, such as the out-of-plane bending vibration of the aromatic ring CH. However, a large number of peaks are present in the range below 1,500 $cm^{-1}$ and it is thus difficult to isolate only binder resin peaks and accurate numerical values cannot be calculated. As a consequence, the absorption peak in the range from 1,713 $cm^{-1}$ to 1,723 $cm^{-1}$, which is easily separated from other peaks, is used as the binder resin-derived peak.

In addition, the absorption peak in the range from 2,843 $cm^{-1}$ to 2,853 $cm^{-1}$ is a peak in FT-IR spectra that originates mainly with a —$CH_2$— stretching vibration (symmetric) originating with the wax.

In addition to this, a peak for a $CH_2$ in-plane bending vibration from 1,450 $cm^{-1}$ to 1,500 $cm^{-1}$ can be detected as a wax peak. However, this is also overlapped by a binder resin-derived peak and isolation of the wax peak is problematic. As a consequence, the absorption peak in the range from 2,843 $cm^{-1}$ to 2,853 $cm^{-1}$, which is easily separated from other peaks, is used as the wax-derived peak.

The reason, in the determination of Pa and Pc, for subtracting the average value of the absorption peak intensities at 3,050 $cm^{-1}$ and 2,600 $cm^{-1}$ from the maximum value of the absorption peak intensity in the range from 2,843 $cm^{-1}$ to 2,853 $cm^{-1}$ is to eliminate the influence of the baseline and calculate a true peak intensity. Since as a rule there are no absorption peaks in the vicinity of 3,050 $cm^{-1}$ and 2,600 $cm^{-1}$, the baseline intensity can be calculated by calculating the average value for these two points. The same reason applies in the determination of Pb and Pd for subtracting the average value of the absorption peak intensities at 1,763 $cm^{-1}$ and 1,630 $cm^{-1}$ from the maximum value of the absorption peak intensity in the range from 1,713 $cm^{-1}$ to 1,723 $cm^{-1}$.

The binder resin-derived maximum absorption peak intensities (Pb and Pd) and the wax-derived maximum absorption peak intensities (Pa and Pc) correlate with the amounts of binder resin and wax present. Therefore, in the present invention the wax-to-binder resin abundance ratios are calculated by dividing the wax-derived maximum absorption peak intensity by the binder resin-derived maximum absorption peak intensity.

The results of investigations by the present inventors have shown that P1 correlates with the image gloss and resistance to wrap-around during fixing. This is thought to occur for the following reasons.

The wax-to-binder resin abundance ratio is made appropriately large to approximately 0.3 μm in the depth direction from the toner particle surface by adjusting P1 into an appropriate range, and outmigration of the wax present in the vicinity of the center of the toner particle is then promoted on the occasion of wax melting. As a result, even with an image-forming apparatus that carries out high-speed image formation, the wax melts rapidly in the fixing step and outmigrates in a satisfactory amount and as a consequence a release effect is exhibited and an excellent releaseability between the fixing member and the toner layer is brought about.

In specific terms, P1 is preferably from 0.10 to 0.70 and is more preferably from 0.12 to 0.66.

P1 can be controlled by changing the conditions during the heat treatment and by controlling the type and/or content of the wax incorporated in the toner particle prior to the heat treatment. For example, in order to increase P1, available methods include raising the temperature of the heat treatment and increasing the content of the wax in the toner particle. On the other hand, in order to lower P1, available methods include lowering the temperature in the heat treatment and lowering the content of the wax in the toner particle. However, the control of P1 by these methods is problematic because they provide a too rapid rate of change in P1. Therefore, control of the state of dispersion of the wax in the toner particle is preferred in addition to the aforementioned methods. The rate of change in P1 is controlled by doing this. For example, the dispersibility of the wax in the toner particle can also be controlled by incorporating hydrophobic silica particles in the toner particle as an internal additive.

P1 is preferably controlled into the indicated range in order to improve the image gloss and the resistance to wrap-around during fixing. However, waxes are softer because they have lower molecular weights than the binder resin. Due to this, even when P1 is controlled into the indicated range, a large change in the triboelectric charge quantity may be brought about by long-term use and density fluctuations and fogging in white areas may then end up being produced.

Due to this, the stability of the triboelectric charge quantity between the toner and the charge-providing member for imparting charge to the toner is preferably improved by also controlling the wax-to-binder resin abundance ratio (P2) for approximately 1.0 μm in the thickness direction from the toner particle surface.

Here, the burying of the external additive used in the toner is preferably suppressed in the present invention in order to realize stability in the triboelectric charge quantity between the toner and the charge-providing member. Specifically, P2 was used in the present invention as the wax abundance ratio to approximately 1.0 μm because the wax abundance ratio to approximately 1.0 μm was correlated with the suppression of burying of the external additive.

The present inventors hypothesize as follows with regard to the mechanism for this.

In order to suppress timewise changes in the triboelectric charge quantity between the toner and charge-providing member, changes in the toner particle surface that occur through long-term use are preferably suppressed. Specifically, the detachment and burying of the external additive brought about by stresses within the developing device are preferably suppressed.

It is thought that not only the hardness of the toner particle surface, but also the hardness of its underlayer are involved in burying of the external additive. For example, even when a large amount of wax is present in the surfacemost layer of the toner particle, it is thought that burying of the external additive to a degree that causes a loss of its functionality does not occur when this underlayer is structured as a hard resin layer. Accordingly, the wax-to-binder resin abundance ratio (P2) for approximately 1.0 μm in the thickness direction from the toner particle surface is preferably controlled. It is thought that burying of the external additive can be controlled and fluctuations in the triboelectric charge quantity can be suppressed by controlling P2 into a specific range.

Specifically, P2 is preferably from 0.05 to 0.35 and is more preferably from 0.06 to 0.33.

P2 can be controlled by varying the type and/or content of the wax, the dispersion diameter of the wax in the toner particle, and the heat treatment conditions. With regard to the dispersion diameter of the wax in the toner particle, the dispersion diameter of the wax in the toner particle can also be controlled through the incorporation of hydrophobic silica particles in the toner particle as an internal additive.

The methods used to measure the properties of the toner and starting materials in the present invention are described in the following.

[Method for Measuring the Peak Molecular Weight (Mp), Number-Average Molecular Weight (Mn), and Weight-Average Molecular Weight (Mw) of the Resins]

The peak molecular weight (Mp), number-average molecular weight (Mn), and weight-average molecular weight (Mw) were measured as follows using gel permeation chromatography (GPC).

First, the sample (resin) was dissolved in tetrahydrofuran (THF) over 24 hours at room temperature. The obtained solution was filtered across a "Sample Pretreatment Cartridge" solvent-resistant membrane filter with a pore diameter of 0.2 μm (from the Tosoh Corporation) to obtain the sample solution. The sample solution was adjusted to a THF-soluble component concentration of approximately 0.8 mass %. The measurement was performed under the following conditions using this sample solution.

instrument: HLC8120 GPC (detector: RI) (from the Tosoh Corporation)

columns: 7-column train of Shodex KF-801, 802, 803, 804, 805, 806, and 807 (from Showa Denko Kabushiki Kaisha)

eluent: tetrahydrofuran (THF)

flow rate: 1.0 mL/minute oven temperature: 40.0° C.

sample injection amount: 0.10 mL

The calibration curve used to determine the molecular weight of the sample was constructed using polystyrene resin standards (specifically, product name: TSK Standard Polystyrene F-850, F-450, F-288, F-128, F-80, F-40, F-20, F-10, F-4, F-2, F-1, A-5000, A-2500, A-1000, and A-500, from the Tosoh Corporation).

[Method for Measuring the Resin Softening Point]

The softening point of the resins was measured according to the manual provided with the instrument, using a constant-load extrusion-type capillary rheometer (product name: Flowtester CFT-500D Flow Property Evaluation Instrument, from Shimadzu Corporation). With this instrument, while a constant load is applied by a piston from the top of the measurement sample, the measurement sample filled in a cylinder is heated and melted and the melted measurement sample is extruded from a die at the bottom of the cylinder; a flow curve showing the relationship between the amount of piston downward stroke and temperature is obtained from this.

The "melting temperature by the ½ method", as described in the manual provided with the indicated instrument, was used as the softening point in the present invention. The melting temperature by the ½ method is determined as follows.

First, ½ of the difference between Smax, which is the amount of piston downward stroke at the completion of outflow, and Smin, which is the amount of piston downward stroke at the start of outflow, is determined (this value is designated as X, where X=(Smax−Smin)/2). The temperature of the flow curve when the amount of piston downward stroke in the flow curve reaches X is the melting temperature by the ½ method.

The measurement sample used was prepared by subjecting approximately 1.0 g of the resin to compression molding for approximately 60 seconds at approximately 10 MPa in a 25° C. environment using a tablet compression molder (product name: NT-100H, from NPa System Co., Ltd.) to provide a cylindrical shape with a diameter of approximately 8 mm.

The measurement conditions with the CFT-500D are as follows.

test mode: rising temperature method start temperature: 40° C.

saturated temperature: 200° C.

measurement interval: 1.0° C.

ramp rate: 4.0° C./min piston cross section area: 1.000 $cm^2$ test load (piston load): 10.0 kgf (0.9807 MPa)

preheating time: 300 seconds diameter of die orifice: 1.0 mm die length: 1.0 mm

[Method for Measuring the Maximum Endothermic Peak of the Wax]

The peak temperature of the maximum endothermic peak of the wax was measured based on ASTM D 3418-82 using a differential scanning calorimeter (product name: Q1000, TA Instruments). Temperature correction in the instrument detection section was performed using the melting points of indium and zinc, and the amount of heat was corrected using the heat of fusion of indium.

Specifically, approximately 10 mg of the wax was accurately weighed out and this was introduced into an aluminum pan, and the measurement was run at a ramp rate of 10° C./minute in the measurement temperature range between 30° C. and 200° C. using an empty aluminum pan as reference. The measurement was carried out by initially raising the temperature to 200° C., then cooling to 30° C., and then reheating. The peak temperature of the maximum endothermic peak of the wax was taken to be the temperature that gave the maximum endothermic peak in the DSC curve in the 30° C. to 200° C. temperature range in this second ramp-up process.

[Method for Measuring the Contact Angle Relative to Water of the Surface of a Pellet Molding of the Toner]

A CA-X (product name) image processing-based contact angle meter from Kyowa Interface Science Co., Ltd. was used.

The measurement method is as follows.

A sample with a diameter of 27 mm was made by pressing the toner at a pressure of 300 $kN/cm^2$ using a tablet molder.

This sample was fixed on the sample stand and a pure water liquid drop (water drop) was formed on the surface of the sample by feeding pure water from the tip of the liquid drop supply needle. The coordinates of the left edge, right edge, and apex angle of this water drop were determined by image processing, and the contact angle was determined using the following formula from the calculated diameter (2r) and height (h) of the water drop.

$$\omega = 2\tan^{-1}(h/r)$$

The measurement was carried out 20 times per sample, and the average value of the 10 measured values excluding the highest value and the lowest value was used as the contact angle.

[Method for Calculating P1 and P2]

The FT-IR spectra were measured by the ATR method using a Fourier-transform infrared spectrophotometer (product name: Spectrum One, PerkinElmer Inc.) equipped with a Universal ATR Sampling Accessory. The specific measurement procedure and the methods for calculating P1 and P2 and [P1/P2] yielded by dividing P1 by P2 are given in the following.

The angle of incidence for the infrared radiation (λ=5 μm) was set to 45°. A Ge ATR crystal (refractive index=4.0) and a KRS5 ATR crystal (refractive index=2.4) were used as the ATR crystals. The other conditions are as follows.

| | Range |
|---|---|
| Start: | 4,000 $cm^{-1}$ |
| End: | 600 $cm^{-1}$ (Ge ATR crystal)<br>400 $cm^{-1}$ (KRS5 ATR crystal) |
| | Duration |
| Scan number: | 16 |
| Resolution: | 4.00 $cm^{-1}$ |
| Advanced: | perform $CO_2/H_2O$ correction |

[Method for Calculating P1]

(1) The Ge ATR crystal (refractive index=4.0) was installed in the instrument.

(2) Scan type was set to Background and Units was set to EGY and the background was measured.

(3) The Scan type was set to Sample and Units was set to A.

(4) 0.01 g of the toner was accurately weighed onto the ATR crystal.

(5) The sample was pressed by the pressure arm (Force Gauge=90).

(6) The sample was measured.

(7) The obtained FT-IR spectrum was run through baseline correction using Automatic Correction.

(8) The maximum value of the absorption peak intensity in the range from 2,843 $cm^1$ to 2,853 $cm^1$ was calculated (Pa1).

(9) The average value of the absorption peak intensity at 3,050 $cm^{-1}$ and 2,600 $cm^1$ was calculated (Pa2).

(10) Pa1−Pa2=Pa. Pa was defined as the maximum absorption peak intensity in the range from 2,843 $cm^{-1}$ to 2,853 $cm^1$.

(11) The maximum value of the absorption peak intensity in the range from 1,713 $cm^{-1}$ to 1,723 $cm^{-1}$ was calculated (Pb1).

(12) The average value of the absorption peak intensity at 1,763 $cm^{-1}$ and 1,630 cm' was calculated (Pb2).

(13) Pb1−Pb2=Pb. Pb was defined as the maximum absorption peak intensity in the range from 1,713 $cm^{-1}$ to 1,723 $cm^{-1}$.

(14) Pa/Pb=P1.

[Method for Calculating P2]

(1) The KRS5 ATR crystal (refractive index=2.4) was installed in the instrument.

(2) 0.01 g of the toner was accurately weighed onto the ATR crystal.

(3) The sample was pressed by the pressure arm (Force Gauge=90).

(4) The sample was measured.

(5) The obtained FT-IR spectrum was run through baseline correction using Automatic Correction.

(6) The maximum value of the absorption peak intensity in the range from 2,843 $cm^1$ to 2,853 $cm^1$ was calculated (Pc1).

(7) The average value of the absorption peak intensity at 3,050 $cm^1$ and 2,600 $cm^1$ was calculated (Pc2).

(8) Pc1−Pc2=Pc. Pc was defined as the maximum absorption peak intensity in the range from 2,843 $cm^{-1}$ to 2,853 $cm^1$.

(9) The maximum value of the absorption peak intensity in the range from 1,713 $cm^{-1}$ to 1,723 $cm^{-1}$ was calculated (Pd1).

(10) The average value of the absorption peak intensity at 1,763 $cm^{-1}$ and 1,630 $cm^{-1}$ was calculated (Pd2).

(11) Pd1−Pd2=Pd. Pd was defined as the maximum absorption peak intensity in the range from 1,713 $cm^{-1}$ to 1,723 $cm^{-1}$.

(12) Pc/Pd=P2.

[Method for Calculating P1/P2]

P1/P2 was calculated using the thusly determined P1 and P2.

EXAMPLES

The present invention is specifically described herebelow based on examples. However, the present invention is in no way limited to or by these.

[Intermediate Transfer Member 1 Production Example]

The polyimide intermediate transfer belt installed in an electrophotographic apparatus (electrophotographic system image-forming apparatus, product name: iRC2620, Canon, Inc.) was used as the substrate layer. The intermediate transfer members according to the examples and comparative examples were fabricated by forming a surface layer by the below-described methods on the surface of this substrate layer.

The properties (volume resistivity, surface resistivity, microhardness, amount of wear, average long diameter of the domains, domain area) of the intermediate transfer belt 1 used in Example 1 below are shown in Table 1, and the results of the image evaluations for Example 1 are given in Table 5.

In addition, it could be confirmed for the intermediate transfer belt 1 of Example 1 that it presented a matrix-domain structure in the cross section in the thickness direction of the surface layer, that this matrix contained a binder resin, and that the domains contained PFPE.

| | |
|---|---|
| dipentaerythritol hexaacrylate | 8.0 mass parts |
| pentaerythritol tetraacrylate | 17.0 mass parts |
| pentaerythritol triacrylate | 5.0 mass parts |
| methyl ethyl ketone | 43.0 mass parts |
| ethylene glycol | 15.0 mass parts |
| finely divided antimony-doped tin oxide particles (product name: SN-100P, from Ishihara Sangyo Kaisha, Ltd.) | 4.0 mass parts |
| photopolymerization initiator (product name: Irgacure 184, Ciba-Geigy) | 2.0 mass parts |
| dispersing agent (product name: GF-300 (solids concentration: 25%), from Toagosei Co., Ltd.) | 20.0 mass parts |
| PFPE having the structure shown by formula (1) above (product name: MD500 (number-average molecular weight: 1700), from Solvay Solexis, Inc.) | 7.0 mass parts |

These materials were mixed and dispersed with a stirring-type homogenizer (from the AS ONE Corporation) followed by further dispersion using a Nanomizer disperser (Yoshida Kikai Co., Ltd.) to obtain a mixture/dispersion of these materials. This mixture/dispersion was coated on the surface of the aforementioned polyimide intermediate transfer belt to form a coating film; the coating film was dried at 70° C. for 3 minutes; and intermediate transfer belt 1 having a surface layer with a film thickness of 4 μm was obtained by exposure to 500 mJ/$cm^2$ ultraviolet radiation. The properties of the obtained intermediate transfer belt 1 are shown in Table 1.

[Intermediate Transfer Member 2 Production Example]

The following changes were made in the Intermediate Transfer Member 1 Production Example: the dipentaerythritol hexaacrylate was not used; the amount of use of the pentaerythritol tetraacrylate was changed to 20.0 mass parts; and the amount of use of the pentaerythritol triacrylate was changed to 10.0 mass parts. With these exceptions, an intermediate transfer belt 2 was obtained by fabrication by the same method as for the intermediate transfer member 1. The properties of the obtained intermediate transfer belt 2 are given in Table 1.

[Intermediate Transfer Member 3 Production Example]

The following changes were made in the Intermediate Transfer Member 2 Production Example: the amount of use of the dispersing agent was changed to 64.0 mass parts and the amount of use of the PFPE was changed to 21.0 mass parts. With these exceptions, an intermediate transfer belt 3 was obtained by fabrication by the same method as for the intermediate transfer member 1. The properties of the obtained intermediate transfer belt 3 are given in Table 1.

[Intermediate Transfer Member 4 Production Example]

The following changes were made in the Intermediate Transfer Member 3 Production Example: the pentaerythritol triacrylate was not used; 20.0 mass parts of 2-ethylhexyl acrylate was used; and 10.0 mass parts of butyl acrylate was used. With these exceptions, an intermediate transfer belt 4 was obtained by fabrication by the same method as for the intermediate transfer member 3. The properties of the obtained intermediate transfer belt 4 are given in Table 1.

[Intermediate Transfer Member 5 Production Example]

The following changes were made in the Intermediate Transfer Member 1 Production Example: the dispersing agent was not used and the amount of use of the PFPE was changed to 30.0 mass parts. With these exceptions, an intermediate transfer belt 5 was obtained by fabrication by the same method as in the Intermediate Transfer Member 1 Production Example. The properties of the obtained intermediate transfer belt 5 are given in Table 1.

When the cross section in the thickness direction of the intermediate transfer belt 5 was submitted to SEM observation, a matrix-domain structure could not be confirmed—in contrast to the intermediate transfer belts according to the examples. Due to this, the average long diameter of the domains and the domain area could not be measured with intermediate transfer belt 5.

[Intermediate Transfer Member 6 Production Example]

The following change was made in the Intermediate Transfer Member 5 Production Example: the amount of use of the PFPE was changed to 0.3 mass parts. With this exception, an intermediate transfer belt 6 was obtained by fabrication by the same method as in the Intermediate Transfer Member 5 Production Example. The properties of the obtained intermediate transfer belt 6 are given in Table 1.

When the cross section in the thickness direction of the intermediate transfer belt 6 was submitted to SEM observation, a matrix-domain structure could not be confirmed—in contrast to the intermediate transfer belts according to the examples. Due to this, the average long diameter of the domains and the domain area could not be measured with intermediate transfer belt 6.

[Intermediate Transfer Member 7 Production Example]

The following changes were made in the Intermediate Transfer Member 3 Production Example: the PFPE (MD500) was changed to PFPE (product name: 5113X (number-average molecular weight: 1,000), from Solvay Solexis, Inc.) and its amount of use was changed to 32.5 mass parts. With these exceptions, an intermediate transfer belt 7 was obtained by fabrication by the same method as in the Intermediate Transfer Member 3 Production Example. The properties of the obtained intermediate transfer belt 7 are given in Table 1.

When the cross section in the thickness direction of this intermediate transfer belt 7 was submitted to SEM observation, a matrix-domain structure could not be confirmed—in contrast to the intermediate transfer belts according to the examples. Due to this, the average long diameter of the domains and the domain area could not be measured with intermediate transfer belt 7.

[Intermediate Transfer Member 8 Production Example]

The following changes were made in the Intermediate Transfer Member 1 Production Example: the dipentaerythritol hexaacrylate, pentaerythritol tetraacrylate, and pentaerythritol triacrylate were not used. In addition, 30.0 mass parts of butyl acrylate was used and the amount of use of the PIPE was changed to 15.0 mass parts. With these exceptions, an intermediate transfer belt 8 was obtained by fabrication by the same method as for the intermediate transfer member 1. The properties of the obtained intermediate transfer belt 8 are given in Table 1.

While the Taber abrasion test was run using intermediate transfer belt 8, the surface layer of intermediate transfer belt 8 ended up being completely scraped off, and as a consequence the amount of wear could not be measured.

TABLE 1

| | volume resistivity (Ω · cm) | surface resistivity (Ω/□) | micro-hardness (MPa ) | amount of wear (mg) | average long diameter of the domains (nm) | domain area (area %) | contact angle relative to water θ(B) |
|---|---|---|---|---|---|---|---|
| intermediate transfer belt 1 | $1.8 \times 10^{10}$ | $4.4 \times 10^{11}$ | 310 | 1.8 | 50 | 39 | 120° |
| intermediate transfer belt 2 | $3.1 \times 10^{10}$ | $2.2 \times 10^{11}$ | 290 | 1.9 | 70 | 33 | 118° |
| intermediate transfer belt 3 | $5.2 \times 10^{11}$ | $6.3 \times 10^{12}$ | 120 | 3.0 | 100 | 40 | 135° |
| intermediate transfer belt 4 | $6.2 \times 10^{10}$ | $4.2 \times 10^{11}$ | 50 | 5.0 | 500 | 19 | 105° |
| intermediate transfer belt 5 | $8.1 \times 10^{9}$ | $4.4 \times 10^{11}$ | 430 | 0.5 | — | — | 155° |
| intermediate transfer belt 6 | $6.2 \times 10^{9}$ | $1.4 \times 10^{10}$ | 450 | 0.3 | — | — | 60° |
| intermediate transfer belt 7 | $1.7 \times 10^{10}$ | $5.5 \times 10^{11}$ | 160 | 3.1 | — | — | 102° |
| intermediate transfer belt 8 | $2.0 \times 10^{11}$ | $3.4 \times 10^{12}$ | 20 | — | 400 | 17 | 107° |

[Photosensitive Member 1 Production Example]

An aluminum cylinder with a diameter of 30 mm was prepared for hardness testing and for in-machine testing. The aluminum cylinder was subjected to a honing treatment and ultrasound/water cleaning to provide a support (electroconductive support).

64 parts (0.06 mol) of an 85% butanolic solution of zirconium tetra-n-butoxide (from Kanto Chemical Co., Inc.) and 22 parts (0.14 mol) of titanium tetra-n-butoxide (from Kishida Chemical Co., Ltd.) were added dropwise into 160 parts of methoxyethanol and a mixed solution of methoxyethanol/water=160 parts/11 parts was further added. Then, a solution of 20 parts acetylacetone added to 200 parts methanol was also added dropwise, followed by the admixture of 55 parts of a 10 mass % methanolic solution of hydroxypropyl cellulose (from Tokyo Chemical Industry Co., Ltd.) to produce an undercoat layer coating liquid.

This undercoat layer coating liquid was dip coated on the support and the obtained coating film was dried for 15 minutes at 120° C. to form an undercoat layer having a film thickness of 0.3 am.

The following were then introduced into a sand mill that used glass beads having a diameter of 1 mm: 3 parts of an oxytitanium phthalocyanine crystal having strong peaks at Bragg angles 20±0.2° of 9.0°, 14.2°, 23.9°, and 27.1° in CuKα X-ray diffraction, 3 parts of polyvinyl butyral (product name: S-LEC BM2, from Sekisui Chemical Co., Ltd.), and 35 parts of cyclohexanone. A dispersing treatment was carried out for 2 hours, followed by the addition of 60 parts of ethyl acetate to produce a charge generation layer coating liquid.

This charge generation layer coating liquid was dip coated on the undercoat layer and the obtained coating film was dried for 10 minutes at 50° C. to form a charge generation layer having a film thickness of 0.2 μm.

10 parts of the styryl compound given by the following structural formula (1)

(1)

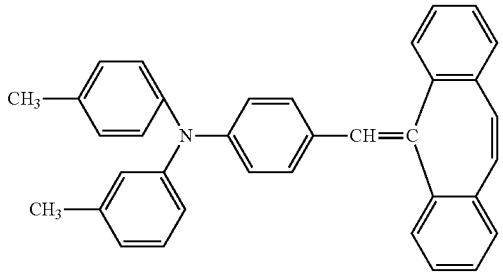

and 10 parts of a polycarbonate resin having a structural unit given by the following structural formula (2)

(2)

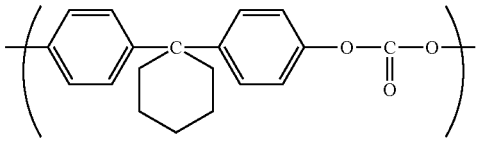

(Mv ≈ 20000)

were dissolved in a mixed solvent of 50 parts monochlorobenzene/30 parts dichloromethane to prepare a charge transport layer coating liquid.

This charge transport layer coating liquid was dip coated on the charge generation layer and the obtained coating film was dried for 1 hour at 120° C. to form a charge transport layer having a film thickness of 10 μm.

60 parts of the hole transport compound given by the following structural formula (3)

(3)

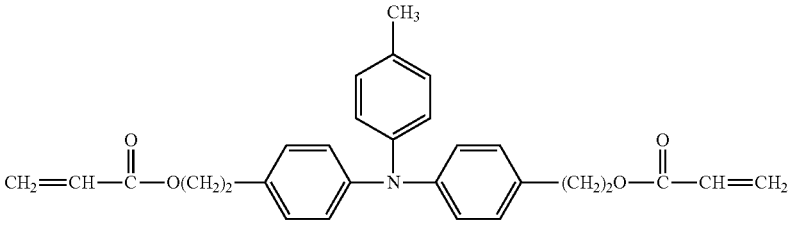

was dissolved in a mixed solvent of 50 parts monochlorobenzene/50 parts dichloromethane and 10 parts of polytetrafluoroethylene (PTFE) particles was also added. A protective layer coating liquid was then prepared by carrying out a dispersion treatment with a high-pressure disperser (Microfluidizer from Microfluidics).

This protective layer coating liquid was dip coated on the charge transport layer to form a coating film. This coating film was exposed to an electron beam at an acceleration voltage of 150 kV and an exposure dose of 4 Mrad in an atmosphere having an oxygen concentration of 10 ppm. This was followed by a heat treatment in the same atmosphere for 10 minutes under conditions in which the temperature of the coating film reached 100° C. to form a protective layer having a film thickness of 5 μm.

Proceeding in this manner, a photosensitive member 1 was fabricated that had an undercoat layer, a charge generation layer, a charge transport layer, and a protective layer on the support in the indicated sequence wherein the protective layer was the surface layer. The properties of the obtained photosensitive member 1 are given in Table 2.

[Photosensitive Member 2 Production Example]

An undercoat layer and a charge generation layer were formed on a support proceeding in the same manner as for the photosensitive member 1.

(4)

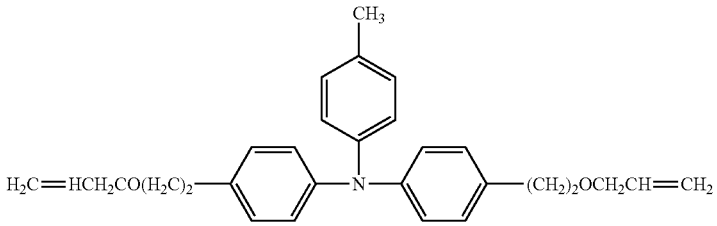

60 parts of the hole transport compound having the structure given by the preceding formula (4) was then dissolved in a mixed solvent of 30 parts monochlorobenzene/30 parts dichloromethane to prepare a charge transport layer coating liquid.

This charge transport layer coating liquid was dip coated on the charge generation layer to form a coating film. This coating film was exposed to an electron beam at an acceleration voltage of 150 kV and an exposure dose of 12 Mrad in an atmosphere having an oxygen concentration of 10 ppm. This was followed by a heat treatment in the same atmosphere for 10 minutes under conditions in which the temperature of the coating film reached 100° C. to form a charge transport layer having a film thickness of 15 μm.

Proceeding in this manner, a photosensitive member 2 was fabricated that had an undercoat layer, a charge generation layer, and a charge transport layer on the support in the indicated sequence wherein the charge transport layer was the surface layer. The properties of the obtained photosensitive member 2 are given in Table 2.

[Photosensitive Member 3 Production Example]

The hole transport compound used in the protective layer was changed from the hole transport compound given by structural formula (3) above to the hole transport compound given by the following structural formula (5).

(5)

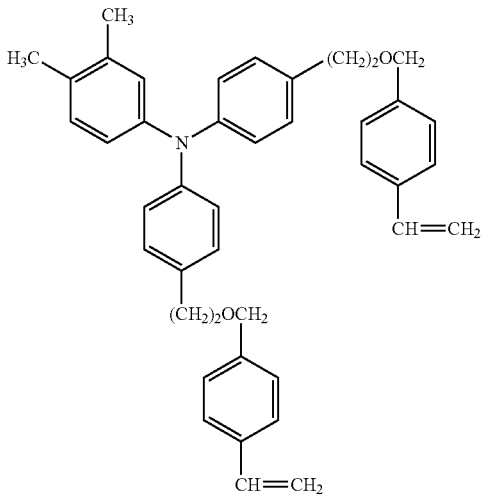

With this exception, a photosensitive member 3 was fabricated proceeding as for photosensitive member 1. The properties of the obtained photosensitive member 3 are given in Table 2.

[Photosensitive Member 4 Production Example]

The protective layer coating liquid was prepared using the following procedure after the charge transport layer had been formed in the Photosensitive Member 1 Production Example.

A solution prepared by mixing 100 parts of finely divided antimony-containing tin oxide particles having an average particle diameter of 0.02 μm (product name: T-1, from Mitsubishi Materials Corporation), 30 parts of (3,3,3-trifluoropropyl)trimethoxysilane (from Shin-Etsu Chemical Co., Ltd.), and 300 parts of a 95% ethanol-5% water solution was introduced into a milling device. After a dispersion treatment for 1 hour, the solution was filtered; after washing with ethanol, drying was carried out; and the finely divided tin oxide particle surface was treated by heating for 1 hour at 120° C.

The following were mixed and introduced into a sand mill: 25 parts of the curable acrylic monomer given by the following structural formula (6) as a photopolymerizable monomer, (6)

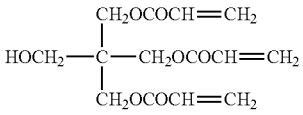

5 parts of 2,2-dimethoxy-2-phenylacetophenone as a photopolymerization initiator, 50 parts of the aforementioned surface-treated antimony-containing tin oxide particles, and 300 parts of ethanol. A dispersion treatment was carried out for 96 hours; 20 parts polytetrafluoroethylene particles (product name: Lubron L-2, from Daikin Industries, Ltd.) was mixed into the obtained dispersion; and 10 parts polytetrafluoroethylene particles was also added. A protective layer coating liquid was then prepared by carrying out a dispersion treatment with a high-pressure disperser (Microfluidizer from Microfluidics).

This protective layer coating liquid was dip coated on the charge transport layer; the obtained coating film was dried; and a protective layer having a film thickness of 3 μm was formed by exposure to ultraviolet radiation for 30 seconds from a metal halide lamp at a light intensity of 1,000 $mW/cm^2$.

Photosensitive member 4 was fabricated proceeding in this manner. The properties of the obtained photosensitive member 4 are shown in Table 2.

[Photosensitive Member 5 Production Example]

An undercoat layer and a charge generation layer were formed on a support proceeding as for photosensitive member 1.

Then, as charge transport materials, 9 parts of the compound given by the following structural formula (7), (7)

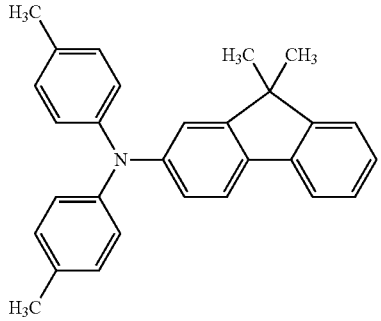

1 part of the compound given by the following structural formula (8), (8)

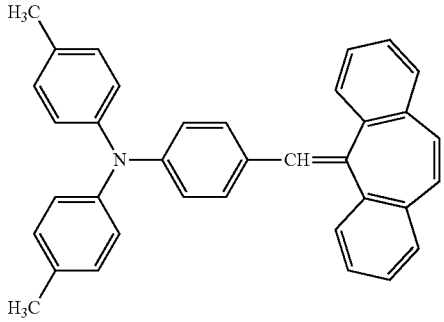

and 12.5 parts of a polyarylate resin (weight-average molecular weight: 100,000) having a structural unit given by the following formula (9)

(9)

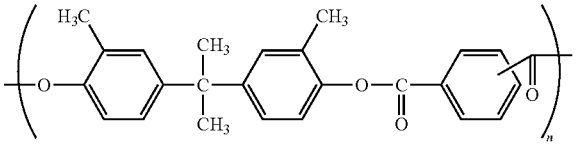

and 0.025 parts of the silicone-modified resin (weight-average molecular weight: 5,000) given by the following formula (10)

(10)

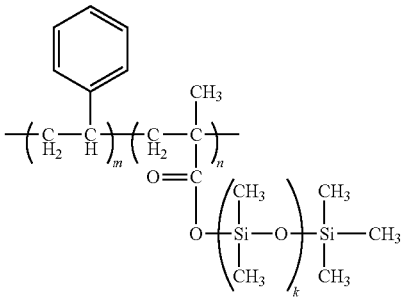

were dissolved in a mixed solvent of 40 parts dimethoxymethane/60 parts monochlorobenzene to prepare a charge transport layer coating liquid.

This charge transport layer coating liquid was dip coated on the charge generation layer and the obtained coating film was dried at 120° C. for 1 hour to form a charge transport layer with a film thickness of 28 μm.

Photosensitive member 5 was fabricated proceeding in this manner. The properties of the obtained photosensitive member 5 are shown in Table 2.

[Photosensitive Member 6 Production Example]

The amount of use of the polytetrafluoroethylene particles for the photosensitive member 4 was changed to 5.0 parts. With this exception, photosensitive member 6 was fabricated proceeding as in the Photosensitive Member 4 Production Example. The properties of the obtained photosensitive member 6 are shown in Table 2.

[Photosensitive Member 7 Production Example]

The amount of use of the polytetrafluoroethylene particles for the photosensitive member 1 was changed to 20 parts. With this exception, photosensitive member 7 was fabricated proceeding as in the Photosensitive Member 1 Production Example. The properties of the obtained photosensitive member 7 are shown in Table 2.

[Photosensitive Member 8 Production Example]

The amount of use of the polytetrafluoroethylene particles for the photosensitive member 3 was changed to 20 parts. With this exception, photosensitive member 8 was fabricated proceeding as in the Photosensitive Member 3 Production Example. The properties of the obtained photosensitive member 8 are shown in Table 2.

TABLE 2

| | HU ($N/mm^2$) | elastic deformation ratio (%) | Rz (μm) | contact angle relative to water θ (A) |
|---|---|---|---|---|
| photosensitive member 1 | 194 | 55 | 0.55 | 85° |
| photosensitive member 2 | 168 | 54 | 1.4 | 83° |
| photosensitive member 3 | 206 | 51 | 0.8 | 94° |
| photosensitive member 4 | 139 | 42 | 2.8 | 85° |
| photosensitive member 5 | 250 | 45 | 2.0 | 94° |
| photosensitive member 6 | 139 | 50 | 2.8 | 73° |
| photosensitive member 7 | 155 | 50 | 2.8 | 106° |
| photosensitive member 8 | 202 | 52 | 2.8 | 125° |

[Toner Production Examples]

[Binder Resin 1 Production Example]

76.9 mass parts (0.167 mol) of polyoxypropylene(2.2)-2,2-bis(4-hydroxyphenyl)propane, 24.1 mass parts (0.145 mol) of terephthalic acid, and 0.5 mass parts of titanium tetrabutoxide were introduced into a glass 4-liter four-neck flask, which was fitted with a thermometer, stirring rod, condenser, and nitrogen inlet tube and set into a mantle heater. The interior of the flask was then substituted with nitrogen gas; the temperature was thereafter gradually raised while stirring; and a reaction was carried out for 4 hours while stirring at a temperature of 200° C. (first reaction step). This was followed by the addition of 2.0 mass parts (0.010 mol) of trimellitic anhydride and reacting for 1 hour at 180° C. (second reaction step) to obtain a binder resin 1.

This binder resin 1 had an acid value of 10 mg KOH/g and a hydroxyl value of 65 mg KOH/g. Its molecular weights by GPC were a weight-average molecular weight (Mw) of 8,000, a number-average molecular weight (Mn) of 3,500, and a peak molecular weight (Mp) of 5,700, and it had a softening point of 90° C.

[Binder Resin 2 Production Example]

71.3 mass parts (0.155 mol) of polyoxypropylene(2.2)-2,2-bis(4-hydroxyphenyl)propane, 24.1 mass parts (0.145 mol) of terephthalic acid, and 0.6 mass parts of titanium tetrabutoxide were introduced into a glass 4-liter four-neck flask, which was fitted with a thermometer, stirring rod, condenser, and nitrogen inlet tube and set into a mantle heater. The interior of the flask was then substituted with nitrogen gas; the temperature was subsequently gradually raised while stirring; and a reaction was carried out for 2 hours while stirring at a temperature of 200° C. (first reaction step). This was followed by the addition of 5.8 mass parts (0.030 mol %) of trimellitic anhydride and reacting for 10 hours at 180° C. (second reaction step) to obtain a binder resin 2.

This binder resin 2 had an acid value of 15 mg KOH/g and a hydroxyl value of 7 mg KOH/g. Its molecular weights by GPC were a weight-average molecular weight (Mw) of 200,000, a number-average molecular weight (Mn) of 5,000, and a peak molecular weight (Mp) of 10,000, and it had a softening point of 130° C.

[Polymer A Production Example]

| | |
|---|---|
| low-density polyethylene (Mw 1,400, Mn 850, maximum endothermic peak by DSC = 100° C.) | 18 mass parts |
| styrene | 66 mass parts |
| n-butyl acrylate | 13.5 mass parts |
| acrylonitrile | 2.5 mass parts |

were charged to an autoclave and, after the interior of the system had been substituted by $N_2$, were held at 180° C. while heating and stirring. 50 mass parts of a 2 mass % xylene solution of t-butyl hydroperoxide was continuously added dropwise over five hours to the system, and after cooling the solvent was separated and removed to obtain a polymer A in which a vinyl resin component was reacted into the low-density polyethylene. Measurement of the molecular weight of polymer A gave a weight-average molecular weight (Mw) of 7,100 and a number-average molecular weight (Mn) of 3,000. In addition, the transmittance at a wavelength of 600 nm, as measured at 25° C. on a dispersion prepared by dispersion in a 45 volume % aqueous methanol solution, was 69%.

[Polymer B Production Example]

| | |
|---|---|
| low-density polyethylene (weight-average molecular weight (Mw) = 1,300, number-average molecular weight (Mn) = 800, maximum endothermic peak by DSC = 95° C.) | 20 mass parts |
| o-methylstyrene | 65 mass parts |
| n-butyl acrylate | 11 mass parts |
| methacrylonitrile | 4.0 mass parts |

The materials listed above were charged to an autoclave and, after the interior of the system had been substituted by $N_2$, were held at 170° C. while heating and stirring. 50 mass parts of a 2 mass % xylene solution of t-butyl hydroperoxide was continuously added dropwise over five hours to the system, and after cooling the solvent was separated and removed to obtain a polymer B in which a vinyl resin component was reacted into the low-density polyethylene. Measurement of the molecular weight of polymer B gave a weight-average molecular weight (Mw) of 6,900 and a number-average molecular weight (Mn) of 2,900. In addition, the transmittance at a wavelength of 600 nm, as measured at 25° C. on a dispersion prepared by dispersion in a 45 volume % aqueous methanol solution, was 63%.

[Finely Divided Silica Particle 1 Production Example]

The combustion furnace for production of the finely divided silica particles used a hydrocarbon-oxygen mixture burner that had a dual-tube structure that could form an inner flame and an outer flame. A dual-fluid nozzle for slurry injection was grounded to the center of the burner and the starting silicon compound was introduced. A hydrocarbon-oxygen combustible gas was injected from the periphery of the dual-fluid nozzle and an inner flame, which was a reducing atmosphere, and an outer flame were formed. For example, the atmosphere, temperature, and flame length could be adjusted by controlling the amount and flow rate of the combustible gas and oxygen. Finely divided silica particles were formed in the flame from the silicon compound and were additionally melt-adhered until the specified particle diameter was reached. This was followed by cooling and then recovery by collection with, for example, a bag filter.

The finely divided silica particles were produced using hexamethylcyclotrisiloxane as the starting silicon compound, and a surface treatment was performed at 0.4 mass % hexamethyldisilazane for 99.6 mass % of the obtained finely divided silica particles.

[Toner 1 Production Example]

| | |
|---|---|
| binder resin 1 | 50.0 mass parts |
| binder resin 2 | 50.0 mass parts |
| Fischer-Tropsch wax (peak temperature of maximum endothermic peak = 76° C.) | 6.0 mass parts |
| C. I. Pigment Blue 15:3 | 5.0 mass parts |
| aluminum 3,5-di-t-butylsalicylate compound | 0.5 mass parts |
| polymer A | 5.0 mass parts |

The materials listed above were mixed using a Henschel mixer (Model FM-75, Mitsui Mining Co., Ltd.) under conditions of a rotation rate of 20 $s^{-1}$ and a rotation time of 5 minutes followed by kneading with a twin-screw kneader (Model PCM-30, Ikegai Corporation) set to 125° C. The obtained kneadate was cooled and was coarsely pulverized to 1 mm or less with a hammer mill to obtain a coarsely pulverized material. The obtained coarsely pulverized material was finely pulverized with a mechanical pulverizer (product name: T-250, Turbo Kogyo Co., Ltd.). This was followed by classification using a rotary classifier (product name: 200TSP, Hosokawa Micron Corporation) to obtain toner particles. The classification rotor rotation rate was made 50.0 $s^{-1}$ as an operating condition for the rotary classifier (product name: 200TSP, Hosokawa Micron Corporation). The obtained toner particles had a weight-average particle diameter (D4) of 5.7 μm. 4.5 mass parts of the finely divided silica particle 1 was added to 100 mass parts of the obtained toner particles; mixing was carried out with a Henschel mixer (Model FM-75, Mitsui Mining Co., Ltd.) under conditions of a rotation rate of 30 $s^{-1}$ and a rotation time of 10 minutes; and a heat treatment using the surface treatment apparatus shown in FIG. 1 was performed. The operating conditions were as follows: feed rate=5 kg/hour, hot air current temperature C=220° C., hot air current flow rate=6 $m^3$/minute, cold air current temperature E=5° C., cold air current flow rate=4 $m^3$/minute, absolute moisture content of the cold air current=3 g/$m^3$, blower air current=20 $m^3$/minute, and injection air flow rate=1 $m^3$/minute. The resulting treated toner particles had an average circularity of 0.963 and a weight-average particle diameter (D4) of 6.2 Toner 1 was obtained by the addition, to 100 mass parts of the resulting treated toner particles, of 0.8 mass parts of hydrophobic finely divided silica particles that had been surface-treated with 20 mass % hexamethyldisilazane and that had a number-average primary particle diameter of 10 nm and 0.2 mass parts of finely divided titanium oxide particles that had been surface-treated with 16 mass % isobutyltrimethoxysilane and that had a number-average primary particle diameter of 30 nm, and mixing with a Henschel mixer (Model FM-75, Mitsui Mining Co., Ltd.) under conditions of a rotation rate of 30 $s^{-1}$ and a rotation time of 10 minutes. The properties of the obtained toner are given in Table 3.

[Production Examples for Toners 2 to 11, Toners 13 to 15, and Toner 17]

The amounts of use (amounts of addition) of the WAX and polymer were changed as shown in Table 3 and the hot air current temperature was also changed as shown in Table 3. With these exceptions, toners 2 to 11, toners 13 to 15, and toner 17 were obtained proceeding in the same manner as in the Toner 1 Production Example. The properties of the obtained toners are given in Table 3.

200TSP, Hosokawa Micron Corporation) to obtain toner particles. The classification rotor rotation rate was made 50.0 $s^{-1}$ as an operating condition for the rotary classifier (product name: 200TSP, Hosokawa Micron Corporation). The obtained toner particles had a weight-average particle diameter (D4) of 5.7 Toner 12 was obtained by the addition, to 100 mass parts of the resulting treated toner particles, of 0.8 mass parts of hydrophobic finely divided silica particles that had been surface-treated with 20 mass % hexamethyldisilazane and that had a number-average primary particle diameter of 10 nm and 0.2 mass parts of finely divided titanium oxide particles that had been surface-treated with 16 mass % isobutyltrimethoxysilane and that had a number-average primary particle diameter of 30 nm, and mixing with a Henschel mixer (Model FM-75, Mitsui Mining Co., Ltd.) under conditions of a rotation rate of 30 $s^{-1}$ and a rotation time of 10 minutes. The properties of the obtained toner are given in Table 3.

[Toner 16 Production Example]

The amounts of use (amounts of addition) of the WAX and polymer were changed as shown in Table 3. With these exceptions, toner 16 was obtained proceeding in the same manner as in the Toner 12 Production Example. The properties of the obtained toner are given in Table

TABLE 3

| | WAX | amount of addition (mass parts) | polymer | amount of addition (mass parts) | hot air current treatment | contact angle θ relative to water | P1/P2 |
|---|---|---|---|---|---|---|---|
| toner 1 | Fischer-Tropsch (76° C.) | 6.0 | polymer A | 5.0 | 160° C. | 70° | 1.50 |
| toner 2 | ↑ | 5.0 | polymer A | 5.0 | 130° C. | 72° | 1.28 |
| toner 3 | ↑ | 6.0 | polymer A | 5.0 | 190° C. | 68° | 1.75 |
| toner 4 | ↑ | 3.0 | polymer B | 3.0 | 160° C. | 75° | 1.14 |
| toner 5 | ↑ | 6.0 | polymer B | 6.0 | 160° C. | 66° | 1.90 |
| toner 6 | ↑ | 10.0 | — | — | 160° C. | 60° | 2.25 |
| toner 7 | ↑ | 3.0 | polymer A | 3.0 | 160° C. | 75° | 1.00 |
| toner 8 | ↑ | 3.0 | polymer A | 3.0 | 180° C. | 70° | 1.00 |
| toner 9 | ↑ | 3.0 | polymer B | 3.0 | 130° C. | 63° | 1.03 |
| toner 10 | ↑ | 3.0 | polymer B | 3.0 | 130° C. | 77° | 1.00 |
| toner 11 | ↑ | 3.0 | polymer B | 3.0 | 130° C. | 60° | 1.00 |
| toner 12 | ↑ | 3.0 | — | — | — | 78° | 1.02 |
| toner 13 | ↑ | 5.0 | polymer B | 5.0 | 160° C. | 70° | 1.25 |
| toner 14 | ↑ | 5.0 | polymer B | 5.0 | 160° C. | 70° | 1.21 |
| toner 15 | ↑ | 7.0 | polymer B | 4.0 | 180° C. | 55° | 1.78 |
| toner 16 | ↑ | 5.0 | polymer B | 5.0 | — | 85° | 1.10 |
| toner 17 | ↑ | 4.0 | polymer B | 4.0 | 130° C. | 70° | 1.23 |

[Toner 12 Production Example]

| | |
|---|---|
| binder resin 1 | 50.0 mass parts |
| binder resin 2 | 50.0 mass parts |
| Fischer-Tropsch wax (peak temperature of maximum endothermic peak = 76° C.) | 3.0 mass parts |
| C. I. Pigment Blue 15:3 | 5.0 mass parts |
| aluminum 3,5-di-t-butylsalicylate compound | 0.5 mass parts |

The materials listed above were mixed using a Henschel mixer (Model FM-75, Mitsui Mining Co., Ltd.) under conditions of a rotation rate of 20 $s^{-1}$ and a rotation time of 5 minutes followed by kneading with a twin-screw kneader (Model PCM-30, Ikegai Corporation) set to 125° C. The obtained kneadate was cooled and coarsely pulverized to 1 mm or less with a hammer mill to obtain a coarsely pulverized material. The obtained coarsely pulverized material was finely pulverized with a mechanical pulverizer (product name: T-250, Turbo Kogyo Co., Ltd.). This was followed by classification using a rotary classifier (product name:

TABLE 4

| | toner No. | carrier No. | two-component developer No. | photo-sensitive member No. | inter-mediate transfer member No. | θ(A)-θ(B) |
|---|---|---|---|---|---|---|
| Example 1 | toner 1 | carrier 1 | 1 | 1 | 1 | −35° |
| Example 2 | toner 2 | carrier 1 | 2 | 1 | 1 | −35° |
| Example 3 | toner 3 | carrier 1 | 3 | 1 | 1 | −35° |
| Example 4 | toner 4 | carrier 1 | 4 | 1 | 1 | −35° |
| Example 5 | toner 5 | carrier 1 | 5 | 1 | 1 | −35° |
| Example 6 | toner 6 | carrier 1 | 6 | 1 | 1 | −35° |
| Example 7 | toner 7 | carrier 1 | 7 | 1 | 1 | −35° |
| Example 8 | toner 7 | carrier 1 | 7 | 2 | 1 | −37° |
| Example 9 | toner 7 | carrier 1 | 7 | 3 | 1 | −26° |
| Example 10 | toner 8 | carrier 1 | 8 | 4 | 1 | −35° |
| Example 11 | toner 8 | carrier 1 | 8 | 5 | 1 | −26° |
| Example 12 | toner 9 | carrier 1 | 9 | 4 | 1 | −35° |
| Example 13 | toner 10 | carrier 1 | 10 | 4 | 1 | −35° |
| Example 14 | toner 11 | carrier 1 | 11 | 4 | 1 | −35° |
| Example 15 | toner 12 | carrier 1 | 12 | 4 | 1 | −35° |
| Example 16 | toner 12 | carrier 1 | 12 | 6 | 2 | −45° |
| Example 17 | toner 12 | carrier 1 | 12 | 4 | 4 | −20° |

TABLE 4-continued

| | toner No. | carrier No. | two-component developer No. | photo-sensitive member No. | inter-mediate transfer member No. | θ(A)-θ(B) |
|---|---|---|---|---|---|---|
| Example 18 | toner 12 | carrier 1 | 12 | 6 | 3 | −62° |
| Example 19 | toner 12 | carrier 1 | 12 | 5 | 4 | −11° |
| Example 20 | toner 12 | carrier 1 | 12 | 4 | 7 | −17° |
| Example 21 | toner 12 | carrier 1 | 12 | 4 | 8 | −22° |
| Comparative Example 1 | toner 13 | carrier 1 | 13 | 2 | 6 | 23° |
| Comparative Example 2 | toner 14 | carrier 1 | 14 | 2 | 5 | −72° |
| Comparative Example 3 | toner 14 | carrier 1 | 14 | 7 | 4 | 1° |
| Comparative Example 4 | toner 15 | carrier 1 | 15 | 2 | 4 | −22° |
| Comparative Example 5 | toner 16 | carrier 1 | 16 | 2 | 4 | −22° |
| Comparative Example 6 | toner 17 | carrier 1 | 17 | 8 | 4 | 20° |

[Magnetic Carrier 1 Production Example]

Water was added to 100 mass parts of $Fe_2O_3$ and pulverization was carried for 15 minutes with a ball mill to produce a magnetic core having an average particle diameter of 55 μm.

A mixed solution of 1 mass part of a straight silicone resin (product name: KR271, from Shin-Etsu Chemical Co., Ltd.), 0.5 mass parts of γ-aminopropyltriethoxysilane, and 98.5 mass parts of toluene was added to 100 mass parts of this magnetic core. Reduced-pressure drying was carried out in a solution reduced-pressure kneader at 70° C. for 5 hours while stirring and mixing and the solvent was removed. This was followed by a baking treatment for 2 hours at 140° C. and sieving on a sieve shaker (Model 300MM-2, from Tsutsui Scientific Instruments Co., Ltd., aperture: 75 μm) to obtain magnetic carrier 1.

Example 1

Using a V-mixer (Model V-10, Tokuju Corporation) and conditions of a rotation rate of 0.5 $s^{-1}$ and a rotation time of 5 minutes, a two-component developer 1 was obtained by mixing toner 1 with magnetic carrier 1 so as to provide a toner concentration of 9 mass %. The evaluations described below were performed on the toner, carrier, intermediate transfer member, and photosensitive member combinations described in Table 4. Table 4 also gives the value provided by subtracting the contact angle θ(B) relative to water of the surface of the intermediate transfer member from the contact angle θ(A) relative to water of the surface of the photosensitive member. The results of the evaluations are given in Table 5.

(Evaluation 1) Method for Evaluating the Line Reproducibility

A modified version of a full-color copier from Canon, Inc. (product name: imageRUNNER ADVANCE C5255) was used as the image-forming apparatus.

For the image evaluation, 50,000 prints of an original image with a print percentage of 5% were output either in a high-temperature, high-humidity environment (30° C., 80% RH) or a low-temperature, low-humidity environment (15° C., 10% RH), and this was followed by the output of a fine-line image and evaluation thereof.

A fine-line image having line widths of 60 μm, 120 μm, and 180 μm was output and the presence/absence of toner dropout was inspected visually and with a loupe. The evaluation criteria are given below.

(Evaluation Criteria for the Line Reproducibility)

A: toner dropout is absent, all of the line images are clear and sharp

B: some toner dropout is seen in observation with the loupe

C: some toner dropout locations are seen in the line images by visual observation (Evaluation 2) Method for Evaluating the Transferability A modified version of a full-color copier from Canon, Inc. (product name: imageRUNNER ADVANCE C5255) was used as the image-forming apparatus. A 70,000-print image output durability test (image with a print percentage of 10%) was run in a high-temperature, high-humidity environment (30° C., 80% RH) and in a low-temperature, low-humidity environment (15° C., 10% RH), followed in both cases by the output of a solid image. The residual toner on the photosensitive member (photosensitive drum) after formation of the solid image was captured by the application of transparent polyester pressure-sensitive tape and was stripped off. The stripped-off pressure-sensitive tape was applied onto paper and its density was measured with a spectral densitometer (500 Series, from X-Rite, Incorporated). In addition, the pressure-sensitive adhesive tape was applied by itself onto the paper and the density at this time was also measured. The density difference was calculated by subtracting the latter density value from the former density, and this density difference was evaluated based on the evaluation criteria provided below.

During the 70,000-print continuous image output, image output was carried out using the same developing conditions and transfer conditions as for the first print (no calibration). The transfer material used in the evaluation in the 70,000-print image output durability test was CS-680 plain copy paper (A4 paper, areal weight: 68 g/$m^2$, marketed by Canon Marketing Japan Inc.). Multi-Purpose Paper copy paper (A4 paper, areal weight: 75 g/$m^2$, marketed by Canon Marketing Japan Inc.), popularly known as "Voice Paper", was used for the solid image after the output test.

(Evaluation Criteria for the Transferability)

A: the density difference is less than 0.05

B: the density difference is at least 0.05 but less than 0.10

C: the density difference is at least 0.10 but less than 0.20

(Evaluation 3) Method for Evaluating the Image Unevenness

A modified version of a full-color copier from Canon, Inc. (product name: imageRUNNER ADVANCE C5255) was used as the image-forming apparatus. The image evaluation was carried out by outputting a blue solid image over the entire surface of the evaluation paper.

For the image evaluation, a visual evaluation was performed based on the criteria indicated below on the image formed on the transfer material immediately after the start of image output, after the output of 5,000 prints of the image, and after the output of 50,000 prints of the image; image output was carried out in a high-temperature, high-humidity environment (30° C./80% RH). Multi-Purpose Paper copy paper (A4 paper, areal weight: 75 g/$m^2$, marketed by Canon Marketing Japan Inc.), popularly known as "Voice Paper", was used for the transfer material in the evaluation.

(Criteria for Evaluation of the Image Unevenness)

A: unevenness is completely absent from the image

B: there is almost no unevenness in the image

C: some unevenness is seen in the image (Evaluation 4) Method for Evaluating the Fogging in Non-image Areas (White Background Areas)

Fogging in the white background area was measured before and after a durability test in a high-temperature, high-humidity environment (30° C./80% RH).

The average reflectance Dr (%) of the evaluation paper prior to image output was measured with a reflectometer (product name: REFLECTOMETER MODEL TC-6DS, from Tokyo Denshoku Co., Ltd.).

50,000 prints of an image (print percentage of the image=10%) were output in a high-temperature, high-humidity environment (30° C./80% RH), and the reflectance Ds (%) of the OOH image area: white background area was measured after the durability test (50,000th print). The transfer material used in the evaluation was CS-600 plain copy paper (A4 paper, areal weight: 68 g/m$^2$, marketed by Canon Marketing Japan Inc.). The fogging (%) was calculated from the obtained Dr and Ds (prior to image output and after durability testing) using the formula given below. The resulting fogging was evaluated according to the following evaluation criteria.

$$\text{fogging (\%)} = Dr\ (\%) - Ds\ (\%)$$

(Evaluation Criteria for Fogging)

A: less than 0.5%

B: at least 0.5% but less than 1.0%

C: at least 1.0% but less than 2.0% prints were output of an image that had an image area percentage of 10%. The transfer material used in the evaluation was CS-680 plain copy paper (A4 paper, areal weight: 68 g/m$^2$, marketed by Canon Marketing Japan Inc.). The degree of occurrence of vertical streak-shaped images caused by residual toner that had not been cleaned off was inspected on the image after output of the 1,000 prints and was evaluated based on the evaluation criteria given below.

(Evaluation Criteria for the Cleaning Performance)

A: image defects are entirely absent

B: 2 or 3 fine vertical streak-shaped patterns are produced

C: a number (at least 4) of fine vertical streak-shaped patterns are produced

Examples 2 to 21, Comparative Examples 1 to 6

The same evaluations as in Example 1 were carried out on the toner, carrier, intermediate transfer member, and photosensitive member combinations given in Table 4. Table 4 gives the values provided by subtracting the contact angle θ(B) relative to water of the surface of the intermediate transfer member from the contact angle θ(A) relative to water of the surface of the photosensitive member, and the results of the evaluations are given in Table 5.

TABLE 5

| | line reproducibility | | transferability: density difference | | | | image unevenness | | | fogging | | cleaning performance |
|---|---|---|---|---|---|---|---|---|---|---|---|---|
| | HH | LL | HH | | LL | | immediately after start | after 5,000 prints | after 50,000 prints | | | |
| | rank | rank | | rank | | rank | rank | rank | rank | % | rank | rank |
| Example 1 | A | A | 0.01 | A | 0.01 | A | A | A | A | 0.1 | A | A |
| Example 2 | A | A | 0.01 | A | 0.02 | A | A | A | A | 0.1 | A | A |
| Example 3 | A | A | 0.02 | A | 0.02 | A | A | A | A | 0.2 | A | A |
| Example 4 | A | B | 0.03 | A | 0.04 | A | A | A | A | 0.1 | A | A |
| Example 5 | A | A | 0.03 | A | 0.03 | A | A | A | A | 0.3 | A | A |
| Example 6 | A | B | 0.03 | A | 0.04 | A | A | A | B | 0.5 | B | A |
| Example 7 | A | B | 0.04 | A | 0.04 | A | A | A | A | 0.2 | A | A |
| Example 8 | B | B | 0.04 | A | 0.04 | A | A | A | B | 0.3 | A | B |
| Example 9 | A | B | 0.05 | B | 0.04 | A | A | A | B | 0.6 | B | A |
| Example 10 | A | B | 0.05 | B | 0.04 | A | A | B | B | 0.3 | A | B |
| Example 11 | A | B | 0.05 | B | 0.04 | A | A | B | B | 0.3 | A | B |
| Example 12 | A | A | 0.05 | B | 0.05 | B | A | B | B | 0.5 | B | B |
| Example 13 | B | B | 0.06 | B | 0.05 | B | A | B | B | 0.3 | A | B |
| Example 14 | A | B | 0.06 | B | 0.05 | B | A | B | B | 0.7 | B | B |
| Example 15 | B | B | 0.07 | B | 0.08 | B | B | B | B | 0.2 | A | B |
| Example 16 | B | B | 0.07 | B | 0.08 | B | B | B | B | 0.2 | A | B |
| Example 17 | B | B | 0.07 | B | 0.08 | B | B | B | B | 0.2 | A | B |
| Example 18 | B | B | 0.07 | B | 0.08 | B | B | B | B | 0.2 | A | B |
| Example 19 | B | B | 0.07 | B | 0.08 | B | B | B | C | 0.2 | A | B |
| Example 20 | B | B | 0.08 | B | 0.08 | B | B | B | C | 0.2 | A | B |
| Example 21 | B | B | 0.07 | B | 0.10 | C | B | B | C | 0.3 | A | B |
| Comparative Example 1 | B | B | 0.13 | C | 0.14 | C | B | C | C | 0.2 | A | B |
| Comparative Example 2 | C | C | 0.10 | C | 0.09 | B | B | B | C | 0.2 | A | C |
| Comparative Example 3 | B | B | 0.10 | C | 0.09 | B | B | B | C | 0.2 | A | C |
| Comparative Example 4 | B | B | 0.09 | B | 0.11 | C | B | B | C | 1.5 | C | C |
| Comparative Example 5 | B | B | 0.13 | C | 0.08 | B | B | B | C | 0.3 | A | B |
| Comparative Example 6 | A | B | 0.09 | B | 0.12 | C | B | B | C | 0.2 | A | C |

(Evaluation 5) Method for Evaluating the Cleaning Performance

A 50,000-print image output durability test (image with a print percentage of 10%) was run in a high-temperature, high-humidity (30° C./80% RH), and after this another 1,000

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-209722, filed Oct. 14, 2014, and Japanese Patent Application No. 2015-189878, filed Sep. 28, 2015, which are hereby incorporated by reference herein in their entirety.

What is claimed is:

1. An image-forming method comprising:

a charging step of charging a surface of a photosensitive member;

an electrostatic latent image-forming step of forming an electrostatic latent image on the surface of the charged photosensitive member;

a developing step of developing the electrostatic latent image with a toner to form a toner image;

a primary transfer step of transferring the toner image to a surface of an intermediate transfer member;

a cleaning step of removing a residual toner that remains on the surface of the photosensitive member after the primary transfer step;

a secondary transfer step of transferring to a transfer material the toner image that has been transferred to the surface of the intermediate transfer member; and a fixing step of fixing to the transfer material the toner image that has been transferred to the transfer material, wherein when θ(A) is a contact angle relative to water of the surface of the photosensitive member and θ(B) is a contact angle relative to water of the surface of the intermediate transfer member, θ(B) is from 100° to 150° and θ(A) and θ(B) satisfy the relationship in the following formula (1);

$$-70° \theta(A)-\theta(B)<0° \quad (1)$$

the toner has a toner particle that contains a binder resin; and a contact angle relative to water of a surface of a pellet molding of the toner is from 60° to 80°.

2. The image-forming method according to claim 1, wherein a universal hardness value (HU) provided by indenting the surface of the photosensitive member at a maximum load of 6 mN is from 150 $N/mm^2$ to 220 $N/mm^2$.

3. The image-forming method according to claim 1, wherein the intermediate transfer member is an intermediate transfer member that has a substrate layer and a surface layer;

the surface layer has in a thickness direction thereof a matrix-domain structure having a matrix and a domain;

the matrix contains a binder resin;

the domain contains a perfluoropolyether; and microhardness of the surface of the intermediate transfer member as measured with an ultramicrohardness tester is at least 50 MPa.

4. The image-forming method according to claim 1, wherein the toner particle further comprises:

a wax; and a polymer that has a structure provided by reaction of a vinylic resin component and a hydrocarbon compound.

5. The image-forming method according to claim 1, wherein the toner particle further comprises a wax;

the toner further comprises an external additive; and the toner satisfies the relationship in the following formula (2)

$$1.05 \leq P1/P2 \leq 2.00 \quad (2)$$

(in formula (2), P1=Pa/Pb and P2=Pc/Pd) where

Pa is a maximum absorption peak intensity in a range from 2843 $cm^{-1}$ to 2853 $cm^{-1}$ and Pb is a maximum absorption peak intensity in a range from 1713 $cm^{-1}$ to 1723 $cm^{-1}$, in the FT-IR spectrum measured using the ATR method, Ge for the ATR crystal, and an angle of incidence for infrared radiation of 45°, and Pc is a maximum absorption peak intensity in a range from 2843 $cm^{-1}$ to 2853 $cm^{-1}$ and Pd is a maximum absorption peak intensity in a range from 1713 $cm^{-1}$ to 1723 $cm^{-1}$, in the FT-IR spectrum measured using the ATR method, KRS5 for the ATR crystal, and an angle of incidence for infrared radiation of 45°.

* * * * *